US006045628A

United States Patent [19]

Solntsev et al.

[11] Patent Number: 6,045,628

[45] **Date of Patent: *Apr. 4, 2000**

[54] THIN-WALLED MONOLITHIC METAL OXIDE STRUCTURES MADE FROM METALS, AND METHODS FOR MANUFACTURING SUCH STRUCTURES

[75] Inventors: Konstantin Solntsev, Moscow, Russian Federation; Eugene Shustorovich, Pittsford, N.Y.; Sergei Myasoedov, Moscow, Russian Federation; Vyacheslav Morgunov, Moscow, Russian Federation; Andrei Chernyavsky, Dubna, Russian Federation; Yuri Buslaev, Moscow, Russian Federation; Richard Montano, Falls Church, Va.; Alexander Shustorovich, Pittsford, N.Y.

[73] Assignee: American Scientific Materials Technologies, L.P., New York, N.Y.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/640,269

[22] Filed: Apr. 30, 1996

[51] Int. Cl.[7] ..... C23C 8/06

[52] U.S. Cl. ..... 148/281; 148/282; 148/286; 148/287

[58] Field of Search ..... 148/287, 286, 148/281, 282

[56] References Cited

U.S. PATENT DOCUMENTS

| | | | |
|---|---|---|---|
| 2,201,709 | 5/1940 | Williams et al. | 175/366 |
| 2,205,263 | 6/1940 | Hein | 175/366 |
| 2,917,419 | 12/1959 | Robinson | 148/6.3 |
| 3,660,173 | 5/1972 | Matsuno et al. | 148/6.35 |
| 3,667,270 | 6/1972 | Deurloo | 72/236 |
| 3,892,888 | 7/1975 | Halaby et al. | 427/127 |
| 4,035,200 | 7/1977 | Valentijn | 148/6.35 |
| 4,050,956 | 9/1977 | deBruin et al. | 148/6 |
| 4,189,331 | 2/1980 | Roy | 148/6.31 |
| 4,274,029 | 6/1981 | Buxbaum | 313/204 |
| 4,478,648 | 10/1984 | Zeilinger et al. | 148/6.3 |
| 4,510,261 | 4/1985 | Pereira et al. | 502/304 |
| 4,714,497 | 12/1987 | Poncet | 148/6.35 |
| 4,729,982 | 3/1988 | Thistlethwaite et al. | 502/338 |
| 4,789,659 | 12/1988 | Maat | 502/328 |

(List continued on next page.)

OTHER PUBLICATIONS

Encyclopedia of Material Science and Engineering, vol. 6, M.B. Bever, Ed., Pergaman Press, 1986; one page.

Controlled Atmosphere Tempering, Metal Progress, Ipsen et al., Oct. 1952; pp. 123–128.

*Primary Examiner*—Nam Nguyen
*Assistant Examiner*—Steven H. VerSteeg
*Attorney, Agent, or Firm*—Kenyon & Kenyon

[57] ABSTRACT

Monolithic metal oxide structures, and processes for making such structures, are disclosed. The structures are obtained by heating a metal-containing structure having a plurality of surfaces in close proximity to one another in an oxidative atmosphere at a temperature below the melting point of the metal while maintaining the close proximity of the metal surfaces. Exemplary structures of the invention include open-celled and closed-cell monolithic metal oxide structures comprising a plurality of adjacent bonded corrugated and/or flat layers, and metal oxide filters obtained from a plurality of metal filaments oxidized in close proximity to one another.

14 Claims, 4 Drawing Sheets

U.S. PATENT DOCUMENTS

| | | | |
|---|---|---|---|
| 4,913,980 | 4/1990 | Rowcliffe et al. | 428/632 |
| 4,964,926 | 10/1990 | Hill | 148/325 |
| 5,415,891 | 5/1995 | Liu et al. | 427/243 |
| 5,489,344 | 2/1996 | Martin et al. | 148/284 |
| 5,496,646 | 3/1996 | Bacigalupo | 428/472.2 |
| 5,545,264 | 8/1996 | Hashimoto | 148/283 |
| 5,602,442 | 2/1997 | Jeong | 313/466 |
| 5,639,704 | 6/1997 | Inuzuka et al. | 501/127 |
| 5,643,436 | 7/1997 | Ogawa et al. | 205/324 |
| 5,653,924 | 8/1997 | Ishibashi et al. | 264/86 |
| 5,668,076 | 9/1997 | Yamagushi et al. | 502/343 |
| 5,670,583 | 9/1997 | Wellinghoff | 525/389 |
| 5,672,427 | 9/1997 | Hagiwara et al. | 428/403 |
| 5,703,002 | 12/1997 | Towata et al. | 502/350 |
| 5,723,799 | 3/1998 | Murayama et al. | 75/232 |
| 5,770,310 | 6/1998 | Noguchi et al. | 428/403 |
| 5,776,264 | 7/1998 | McCandlish et al. | 148/237 |
| 5,786,296 | 7/1998 | Shustorovich et al. | 502/439 |
| 5,800,000 | 9/1998 | Shockley | 294/21.3 |
| 5,800,925 | 9/1998 | Ando et al. | 428/432 |
| 5,814,164 | 9/1998 | Shustorovich et al. | 148/287 |
| 5,834,057 | 11/1998 | Edelstein et al. | 427/212 |
| 5,874,153 | 2/1999 | Bode et al. | 428/116 |
| 5,876,866 | 3/1999 | McKee et al. | 428/699 |

THIN-WALLED MONOLITHIC METAL OXIDE STRUCTURES MADE FROM METALS, AND METHODS FOR MANUFACTURING SUCH STRUCTURES

CROSS-REFERENCE TO RELATED APPLICATIONS

This application is related to U.S. Ser. No. 08/336,587, filed Nov. 9, 1994, now U.S. Pat. No. 5,814,164 entitled "Thin-Walled Monolithic Iron Oxide Structures Made From Steels, and Methods for Manufacturing Such Structures."

FIELD OF THE INVENTION

This invention relates to monolithic metal oxide structures made from metals, and methods for manufacturing such structures by heat treatment of metals.

BACKGROUND OF THE INVENTION

Thin-walled structures, combining a variety of thin-walled shapes with the mechanical strength of monoliths, have diverse technological and engineering applications. Typical applications for such materials include gas and liquid flow dividers used in heat exchangers, mufflers, filters, catalytic carriers used in various chemical industries and in emission control for vehicles, etc. In many applications, the operating environment requires a thin-walled structure which is effective at elevated temperatures and/or in corrosive environments.

In such demanding conditions, two types of refractory materials have been used in the art, metals and ceramics. Each suffers from disadvantages. Although metals can be mechanically strong and relatively easy to shape into diverse structures of variable wall thicknesses, they typically are poor performers in environments including elevated temperatures or corrosive media (particularly acidic or oxidative environments). Although many ceramics can withstand demanding temperature and corrosive environments better than many metals, they are difficult to shape, suffer diminished strength compared to metals, and require thicker walls to compensate for their relative weakness compared to metals. In addition, chemical processes for making ceramics often are environmentally detrimental. Such processes can include toxic ingredients and waste. In addition, commonly used processes for making ceramic structures by sintering powders is a difficult manufacturing process which requires the use of very pure powders with grains of particular size to provide desirable densification of the material at high temperature and pressure. Often, the process results in cracks in the formed structure.

Metal oxides are useful ceramic materials. In particular, iron oxides in their high oxidation states, such as hematite ($\alpha$-$Fe_2O_3$) and magnetite ($Fe_3O_4$) are thermally stable refractory materials. For example, hematite is stable in air except at temperatures well in excess of 1400° C., and the melting point of magnetite is 1594° C. These iron oxides, in bulk, also are chemically stable in typical acidic, basic, and oxidative environments. Iron oxides such as magnetite and hematite have similar densities, exhibit similar coefficients of thermal expansion, and similar mechanical strength. The mechanical strength of these materials is superior to that of ceramic materials such as cordierite and other aluminosilicates. Hematite and magnetite differ substantially in their magnetic and electrical properties. Hematite is practically non-magnetic and non-conductive electrically. Magnetite, on the other hand, is ferromagnetic at temperatures below about 575° C. and is highly conductive (about $10^6$ times greater than hematite). In addition, both hematite and magnetite are environmentally benign, which makes them particularly well-suited for applications where environmental or health concerns are important. In particular, these materials have no toxicological or other environmental limitations imposed by U.S. OSHA regulations.

Metal oxide structures have traditionally been manufactured by providing a mixture of metal oxide powders (as opposed to metal powders) and reinforcement components, forming the mass into a desired shape, and then sintering the powder into a final structure. However, these processes bear many disadvantages including some of those associated with processing other ceramic materials. In particular, they suffer from dimensional changes, generally require a binder or lubricant to pack the powder to be sintered, and suffer decreased porosity and increased shrinkage at higher sintering temperatures.

Use of metal powders has been reported for the manufacture of metal structures. However, formation of metal oxides by sintering metal powders has not been considered desirable. Indeed, formation of metal oxides during the sintering of metal powders is considered a detrimental effect which opposes the desired formation of metallic bonds. "Oxidation and especially the reaction of metals and of nonoxide ceramics with oxygen, has generally been considered an undesirable feature that needs to be prevented." Concise Encyclopedia of Advanced Ceramic Materials, R. J. Brock, ed., Max-Planck-Institut fur Metalforschung, Pergamon Press, pp. 124–25 (1991).

In the prior art, it has been unacceptable to use steel starting materials to manufacture uniform iron oxide structures, at least in part because oxidation has been incomplete in prior art processes. In addition, surface layers of iron oxides made according to prior art processes suffer from peeling off easily from the steel bulk.

Heat treatment of steels often has been referred to as annealing. Although annealing procedures are diverse, and can strongly modify or even improve some steel properties, the annealing occurs with only slight changes in the steel chemical composition. At elevated temperatures in the presence of oxygen, particularly in air, carbon and low alloy steels can be partially oxidized, but this penetrating oxidation has been universally considered detrimental. Such partially oxidized steel has been deemed useless and characterized as "burned" in the art, which has taught that "burned steel seldom can be salvaged and normally must be scrapped." "The Making, Shaping and Testing of Steel," U.S. Steel, 10th ed., Section 3, p. 730. "Annealing is . . . used to remove thin oxide films from powders that tarnished during prolonged storage or exposure to humidity." Metals Handbook, Vol. 7, p. 182, Powder Metallurgy, ASM (9th Ed. 1984).

One attempt to manufacture a metal oxide by oxidation of a parent metal is described in U.S. Pat. No. 4,713,360. The '360 patent describes a self-supporting ceramic body produced by oxidation of a molten parent metal to form a polycrystalline material consisting essentially of the oxidation reaction product of the parent metal with a vapor-phase oxidant and, optionally, one or more unoxidized constituents of the parent metal. The '360 patent describes that the parent metal and the oxidant apparently form a favorable polycrystalline oxidation reaction product having a surface free energy relationship with the molten parent metal such that within some portion of a temperature region in which the parent metal is molten, at least some of the grain intersections (i.e., grain boundaries or three-grain-intersections) of the polycrystalline oxidation reaction product are replaced by planar or linear channels of molten metal.

Structures formed according to the methods described in the '360 patent require formation of molten metal prior to oxidation of the metal. In addition, the materials formed according to such processes does not greatly improve strength as compared to the sintering processes known in the art. The metal structure originally present cannot be maintained since the metal must be melted in order to form the metal oxide. Thus, after the ceramic structure is formed, whose thickness is not specified, it is shaped to the final product.

Another attempt to manufacture a metal oxide by oxidation of a parent metal is described in U.S. Pat. No. 5,093,178. The '178 patent describes a flow divider which it states can be produced by shaping the flow divider from metallic aluminum through extrusion or winding, then converting it to hydrated aluminum oxide through anodic oxidation while it is slowly moving down into an electrolyte bath, and finally converting it to $\alpha$-alumina through heat treatment. The '178 patent relates to an unwieldy electrochemical process which is expensive and requires strong acids which are corrosive and environmentally detrimental. The process requires slow movement of the structure into the electrolyte, apparently to provide a fresh surface for oxidation, and permits only partial oxidation. Moreover, the oxidation step of the process of the '178 patent produces a hydrated oxide which then must be treated further to produce a usable working body. In addition, the description of the '178 patent is limited to processing aluminum, and does not suggest that the process might be applicable to iron or other metals. See also, "Directed Metal Oxidation," in *The Encyclopedia of Advanced Materials,* vol. 1, pg. 641 (Bloor et al., eds., 1994).

Accordingly, there is a need for metal oxide structures which are of high strength, efficiently and inexpensively manufactured in environmentally benign processes, and capable of providing refractory characteristics such as are required in demanding temperature and chemical environments. There also is a need for metal oxide structures which are capable of operating in demanding environments, and having a variety of shapes and wall thicknesses.

OBJECTS AND SUMMARY OF THE INVENTION

In light of the foregoing, it is an object of the invention to provide a metal oxide structure which has high strength, is efficiently manufactured, and is capable of providing refractory characteristics such as are required in demanding temperature and chemical environments. It is a further object of the invention to provide metal oxide structures which are capable of operating in demanding environments, and having a variety of shapes and wall thicknesses. It is a further object of the invention to obtain metal oxide structures directly from metal-containing structures, and to retain substantially the physical shape of the metal structure.

These and other objects of the invention are accomplished by a thin-walled monolithic metal oxide structure manufactured by providing a metal structure (such as a steel structure for iron), containing a plurality of surfaces in close proximity to one another, and heating the metal structure at a temperature below the melting point of the metal to oxidize the structure and directly transform the metal to metal oxide, such that the metal oxide structure retains substantially the same physical shape as the metal structure. The initial metal structure can take a variety of forms, which may or may not be monolithic. By varying parameters such as the shape, sizes, arrangement, and packing of the metal, the metal structure can take such exemplary forms as a layered structure (such as a flat-cor or cor-cor structure described below), or can be a filter material having a plurality of filaments.

In one embodiment of the invention, a thin-walled monolithic iron oxide structure is manufactured by providing an iron-containing metal structure (such as a steel structure), and heating the iron-containing metal structure at a temperature below the melting point of iron to oxidize the iron-containing structure and directly transform the iron to hematite, and then to de-oxidize the hematite structure into a magnetite structure. The iron oxide structures of the invention can be made directly from ordinary steel structure, and will substantially retain the shape of the ordinary steel structures from which they are made.

The metal-containing structures of the present invention also may comprise metals other than iron, such as copper, nickel and titanium. The term metal-containing structure refers to structures which may or may not be monolithic, are shaped or formed of metals, alloys, or combinations of metals, and useful as precursors or preforms for the monolithic metal oxide structures of the invention. The metal-containing structures of the invention can include other substances, including impurities, so long as the metal is capable of being oxidized according to the invention.

Metal oxide structures of the invention can be used in a wide variety of applications, including flow dividers, corrosion resistant components of automotive exhaust systems, catalytic supports, filters, thermal insulating materials, and sound insulating materials. A metal oxide structure of the invention containing predominantly magnetite, which is magnetic and electrically conductive, can be electrically heated and, therefore, can be applicable in applications such as electrically heated thermal insulation, electric heating of liquids and gases passing through channels, and incandescent devices which are stable in air. Additionally, combination structures using both magnetite and hematite could be fabricated. For example, the materials of the invention could be combined in a magnetite heating element surrounded by hematite insulation.

DETAILED DESCRIPTION OF THE PREFERRED EMBODIMENTS

Figure 1:
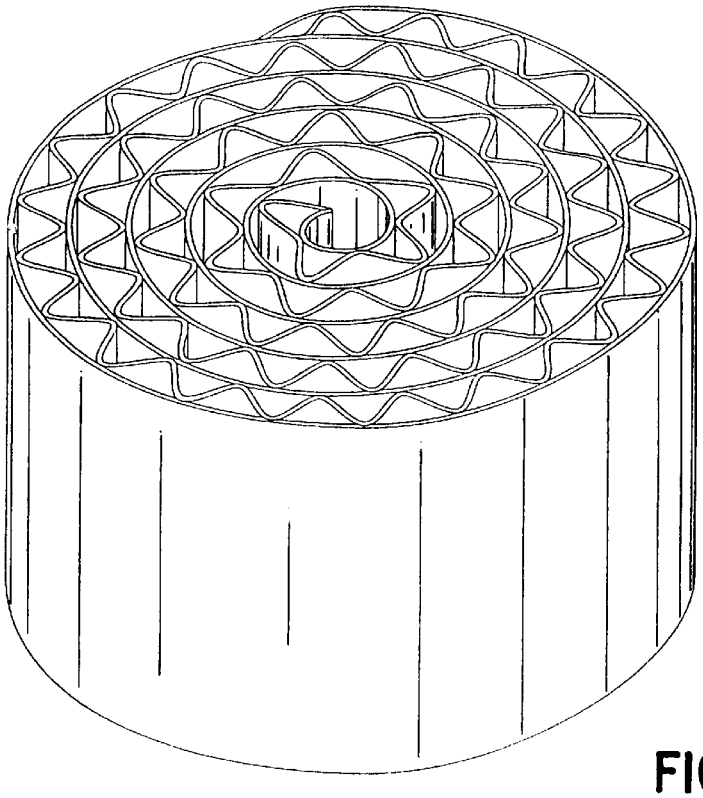
FIG. 1 is a plan view of an exemplary metal structure shaped as a cylindrical flow divider and useful as a starting material for fabricating metal oxide structures.

The present invention relates to the direct transformation of metal-containing materials, especially iron-containing materials, such as thin plain steel foils, ribbons, gauzes, wires, felts, metal textiles such as wools, etc., into monolithic structures made from metal oxide, especially iron oxide, such as hematite, magnetite and combinations thereof. A co-pending application, Ser. No. 08/336,587, filed Nov. 9, 1994, entitled "Thin-Walled Monolithic Iron Oxide Structures Made From Steels, and Methods for Manufacturing Such Structures" describes new structures which can be made by, for example, providing an iron-containing metal structure having a plurality of surfaces in close proximity to one another, and heating the iron-containing metal structure in an oxidative atmosphere at a temperature below the melting point of iron to oxidize the iron-containing structure and directly transform the iron to iron oxide, such that the iron oxide structure retains substantially the same physical shape as the iron-containing metal structure. The disclosure of that application is incorporated herein by reference.

The process of the invention to obtain monolithic metal oxide structures by direct oxidation of metal-containing structures below the metal melting point may be applied to metals other than iron, such as nickel, copper, and titanium. Preferably, the metal is transformed to the metal oxide in its highest oxidation state. The preferred temperatures and other parameters of heat treatment can vary depending on the nature of the metal and its structure, as illustrated in Examples 1 to 4, and 6.

The wall thickness of the starting metal-containing structure is important, preferably less than about 0.6 mm, more preferably less than about 0.3 mm, and most preferably less than about 0.1 mm. The process for carrying out such a transformation comprises forming a metal-containing structure of a desired structure shape, with surfaces in close proximity to one another, and then heating the metal-containing structure to a temperature below the melting point of metal to form a monolithic metal oxide structure having substantially the same shape as the metal-containing starting structure.

Oxidation of iron-containing structures preferably occurs well below the melting point of iron, which is about 1536° C. Formation of hematite ($Fe_2O_3$) structures preferably occurs in air between about 750 and about 1350° C., and more preferably between about 800 and about 1200° C., and most preferably between about 800 and about 950° C.

The melting point of copper is about 1085° C. Oxidation of copper-containing structures in air preferably occurs below about 1000° C., more preferably between about 800 and 1000° C., and most preferably between about 900 and about 950° C. The preferred predominant copper oxide formed is tenorite (CuO).

The melting pint of nickel is about 1455° C. Oxidation of nickel-containing structures in air preferably occurs below about 1400° C., more preferably between about 900 and about 1200° C., and most preferably between about 950 and about 1150° C. The preferred predominant nickel oxide formed is bunsenite (NiO).

The melting point of titanium is about 1660° C. Oxidation of titanium-containing structures in air preferably occurs below about 1600° C., more preferably between about 900 and about 1200° C., and most preferably between about 900 and about 950° C. The preferred predominant titanium oxide formed is rutile ($TiO_2$).

Although magnetite structures can be made by direct transformation of iron-containing structures to magnetite structures, magnetite structures most preferably are obtained by de-oxidizing hematite structures. This can be accomplished either by heating in air between about 1420 and about 1550° C., or preferably by heating in a light vacuum, such as about 0.001 atmospheres, between about 1000 and about 1300° C., and most preferably between about 1200 and about 1250° C. Formation of magnetite structures in a vacuum is preferred because it effectively prevents significant re-oxidation of magnetite to hematite, which can occur when magnetite structures made in accordance with the invention are cooled in air. Formation of magnetite structures in a vacuum at temperatures below about 1400° C. is particularly preferred since energy costs are lower at lower processing temperatures. The processes of the invention are simple, efficient, and environmentally benign in that they need not contain any toxic substances nor create toxic waste.

One significant advantage of the present invention is that it can use relatively cheap and abundant starting materials such as plain steel, such as in the form of hot or cold rolled sheets, for the formation of iron oxide structures. As used in this application, plain steel refers to alloys which comprise iron and less than about 2 weight percent carbon, with or without small amounts of other ingredients which can be formed in steels. In general, any steel or other iron-containing material which can be oxidized into iron oxide by heat treatment well below the melting point of iron metal is within the scope of the present invention.

It has been found that the process of the invention is applicable for steels having a broad range of carbon content, for example, about 0.04 to about 2 weight percent. In particular, high carbon steels such as Russian Steel 3, and low carbon steels such as AISI-SAE 1010, are suitable for use in the invention. Russian Steel 3 contains greater than about 97 weight percent iron, less than about 2 weight percent carbon, and less than about 1 weight percent of other chemical elements (including about 0.3 to about 0.7 weight percent manganese, about 0.2 to about 0.4 weight percent silicon, about 0.01 to about 0.05 weight percent phosphorus, and about 0.01 to about 0.04 weight percent sulfur). AISI-SAE 1010 contains greater than about 99 weight percent iron, about 0.08 to about 0.13 weight percent carbon, about 0.3 to about 0.6 weight percent manganese, about 0.4 weight percent phosphorus, and about 0.05 weight percent sulfur.

It is particularly preferred that a maximum amount of the surface area of the structure be exposed to the oxidative atmosphere during the heating process for metal oxide formation. To enhance the efficiency and completeness of the transformation of the starting metal-containing material to a metal oxide structure, it is important that the initial structure have a sufficiently thin wall, filament diameter, etc. It is preferred that surfaces to be oxidized of the starting structure be less than about 0.6 mm thick, more preferably less than about 0.03 mm thick, and most preferably less than about 0.1 mm thick.

The starting material can take virtually any suitable form desired in the final product, such as thin foils, ribbons, gauzes, wires, felts, metal textiles such as metal wools, etc. A plurality of metal surfaces preferably are in close proximity to one another so that those surfaces can bond during oxidation to form a monolithic metal oxide structure.

Significantly, it is not necessary for any organic or inorganic binders or matrices to be present to maintain the oxide structures formed during the process of the invention, and preferably no such binders or matrices are employed. Thus, the thermal stability, mechanical strength, and uniformity of shape and thickness of the final product can be greatly improved over products incorporating such binders.

Plain steel has a bulk density of about 7.9 gm/cm$^3$, while the bulk density of hematite and magnetite are about 5.2 gm/cm$^3$ and about 5.1 gm/cm$^3$, respectively. Since the density of the steel starting material is higher than for the iron oxide product, the iron oxide structure walls will be thicker than the walls of the starting steel structure, as is illustrated by the data provided in Table I of Example 1 below. The oxide structure wall may contain an internal gap whose width correlates with the wall thickness of the starting structure. It has been found that thinner-walled starting structures generally will have a smaller internal gap after oxidation as compared to thicker-walled starting structures. For example, as seen from Table I in Example 1, the gap width was 0.04 and 0.015 mm, respectively, for iron oxide structures made from foils of 0.1 and 0.025 mm in thickness.

Processes of the invention can employ metal preforms such as foils, gauzes, felts, etc. and/or combinations of said preforms, to make metal oxide structures retaining substantially the same shape and size of the metal preforms. Moreover, the present invention allows two or more metal oxide structures to be bound into one structure, which further expands the scope and flexibility of shapes and sizes which can be obtained according to the present invention.

In one preferred embodiment of the invention, the starting structure is a cylindrical steel disk shaped as a flow divider, such as is depicted in FIG. 1, capable of dividing a gaseous or liquid stream into two or more streams for a length of time or distance. Such a flow divider can be useful, for example, as an automotive catalytic converter. Typically, the disk comprises a first flat sheet of steel adjacent a second corrugated sheet of steel, forming a triangular cell (mesh), which are rolled together to form a disk of suitable diameter. The rolling preferably is tight enough to provide close physical proximity between adjacent sheets. Alternatively, the disk could comprise three or more adjacent sheets, such as a flat sheet adjacent a first corrugated sheet which is adjacent a second corrugated sheet, with the corrugated sheets having different triangular cell sizes.

Figure 4:
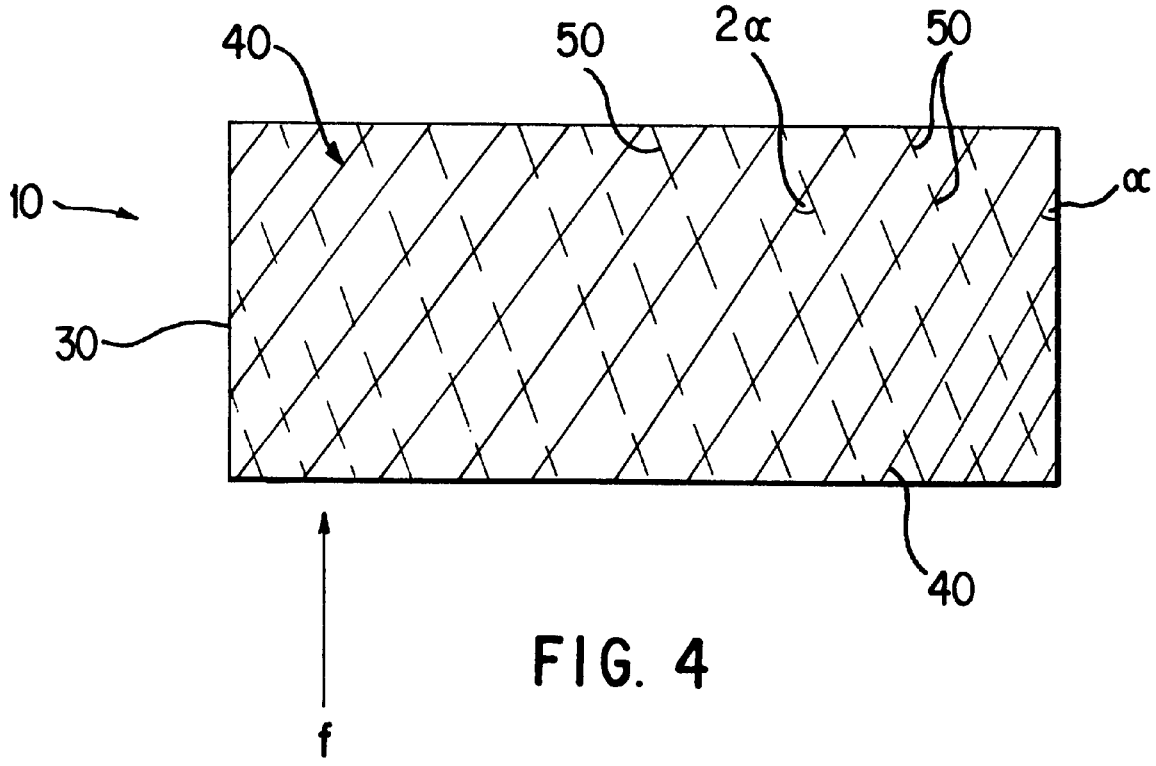
FIG. 4 is a top view of an exemplary cor-cor structure of the invention.

In another preferred embodiment of the invention, the starting steel structure is shaped as a brick-like flow divider with a rectangular cross-section, such as is depicted in FIG. 4. Such a flow divider can also be useful as an automotive catalytic converter. The brick comprises corrugated steel sheets having parallel channels rolled at an angle to the axial flow. Adjacent sheets preferably are stacked while mirror-reflected, which will prevent nesting.

In another preferred embodiment of the invention, the starting brick-like steel structure is formed by a metal felt. Such a structure can be useful as a high void volume filter for gases and liquids.

The size of the structures which can be formed in most conventional ceramic processes is limited. However, there are no significant size limitations for structures formed with the present invention. For example, steel flow dividers which are useful in the invention can vary based on the furnace size, finished product requirements and other factors. Steel flow dividers can range, for example, from about 50 to about 125 mm in diameter, and about 35 to about 150 mm in height. The thickness of the flat sheets is about 0.025 to about 0.1 mm, and the thickness of the corrugated sheets is about 0.025 to about 0.3 mm. The triangular cell formed by the flat and corrugated sheets in such exemplary flow dividers can be adjusted to suit the particular characteristics desired for the iron oxide structure to be formed, depending on the foil thickness and the design of the equipment (such as a tooth roller) used to form the corrugated sheets. For example, for 0.1 mm to 0.3 foils, the cell base can be about 4.0 mm and the cell height about 1.3 mm. For 0.025 to 0.1 mm thick foils, a smaller cell structure could have a base of about 1.9 to about 2.2 mm, and a cell height of about 1.0 to about 1.1 mm. Alternatively, for 0.025 to 0.1 mm thick foils, an even smaller cell structure could have a base of about 1.4 to about 1.5 mm, and a cell height of about 0.7 to about 0.8 mm. Corrugated sheets useful for producing open-cell and closed-cell substrates preferably have a cell density of about 250 to about 1000 cpsi.

For different applications, or different furnace sizes, the dimensions can be varied form the above. In addition, since two more metal oxide structures can be bonded together using the processes of the invention without any required extraneous agents such as binders etc., the shapes and sizes of metal oxide structures, which can be obtained by the invention, can be varied further.

Figure 2:
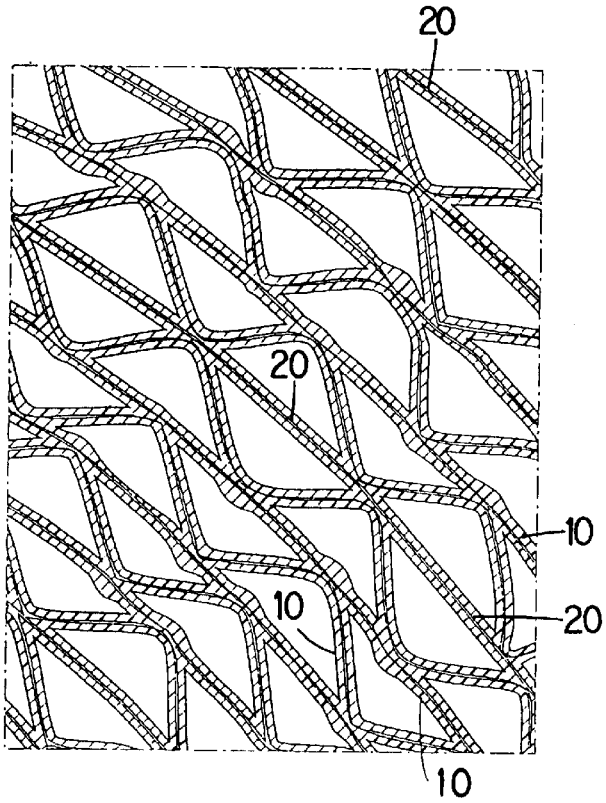
FIG. 2 is a cross-sectional view of an iron oxide structure shaped as a cylindrical flow divider.

The oxidative atmosphere should provide a sufficient supply of oxygen to permit transformation of iron to iron oxide. The particular oxygen amounts, source, concentration, and delivery rate can be adjusted according to the characteristics of the starting material, requirements for the final product, equipment used, and processing details. A simple oxidative atmosphere is air. Exposing both sides of a sheet of the structure permits oxidation to occur from both sides, thereby increasing the efficiency and uniformity of the oxidation process. Without wishing to be bound by theory, it is believed that oxidation of the iron in the starting structure occurs via a diffusional mechanism, most probably by diffusion of iron atoms from the metal lattice to a surface where they are oxidized. This mechanism is consistent with formation of an internal gap in the structure during the oxidation process. Where oxidation occurs from both sides of a sheet 10, the internal gap 20 can be seen in a cross-sectional view of the structure, as is shown in FIG. 2.

Where an iron structure contains regions which vary in their openness to air flow, internal gaps have been found to be wider in the most open regions of a structure, which suggests that oxidation may occur more evenly on both sides of the iron-containing structure than at other regions of the structure. In less open regions of the iron structure, particularly at points of contact between sheets of iron-containing structure, gaps have been found to be narrower or even not visible. Similarly, iron-containing wires can form hollow iron oxide tubes having a central cylindrical void analogous to the internal gap which an be found in iron oxide sheets. Copper, nickel and titanium-containing structures generally are transformed to their corresponding oxide structures with little or no gap formation.

It has been found that by performing a heat treatment subsequent to the initial transformation of iron-containing structures to iron oxide structures, gap formation can be controlled or essentially eliminated, which can lead to more uniform structures which are stronger and/or denser than structures which do contain a gap. Although not wishing to be bound by theory, it is believed that additional heat treatment along the lines of the invention can increase the crystallinity of the material, which can heal cracks and fractures in addition to closing internal gaps.

For iron oxides, the gaps have been found to be practically closed under the hematite to magnetite transition, preferably in a vacuum near the magnetite melting point, which is by 200–300° C. lower than that (1597° C.) at normal atmospheric pressure. The gaps remain closed after re-oxidation of magnetite structures to hematite structures. The re-oxidation can occur, for example, by heating in air about 1400° C. for about 4 hours. The internal gaps also decrease or eventually close under heating hematite structures in air at temperatures favorable for the formation of magnetite, preferably at about 1400 to about 1450° C.

Although not wishing to be bound by theory, it is believed that here at least some transformation of hematite structures to magnetite structures also occurs, but after cooling in air the magnetite structures re-oxidize back to hematite structures which retain the decreased or closed gaps.

In a preferred embodiment, a hematite structure containing a gap is treated by heating at a temperature near the melting point of magnetite, which can be selected in view of other processing parameters such as pressure. At normal atmospheric pressure, the temperature preferably is about 1400° C. to about 1500° C. In a light vacuum, the temperature most preferably is about 1200 to 1300° C. Any suitable atmosphere for carrying out heat treatment may be employed. The preferred atmosphere for gap control heat treatment is a light vacuum such as, for example, a pressure of about 0.001 atmosphere. At that pressure, the most preferred temperature is about 1250° C.

The time for gap control heating can vary with such factors as the temperature, furnace design, rate of air (oxygen) flow, and weight, thickness, shape, size, and open cross-section of the material to be treated. For example, for treatment of hematite sheets or filaments of about 0.1 mm thickness, in a light vacuum in a vacuum furnace at about 1250° C., a heating time of less than about one day, more preferably about 5 to about 120 minutes, and most preferably about 15 to about 30 minutes, is preferred. For larger samples or lower heating temperatures, heating time typically should be longer.

Excessive heating should be avoided because at the employed high temperatures and lower pressures, the vapor pressure of iron oxides is high and a distinct amount of the oxides may evaporate.

After the gap control heat treatment, the treated iron oxide structure preferably is cooled. If desired, the gap control heat treatment process can be repeated. However, the gap control heat treatment process preferably is not carried out more than twice, since the iron oxide can eventually be damaged by excessive repetition of the process.

When iron (atomic weight 55.85) is oxidized to hematite ($Fe_2O_3$) (molecular weight 159.69) or magnetite ($Fe_3O_4$) (molecular weight 231.54), the oxygen content which comprises the theoretical weight gain is 30.05 percent or 27.64 percent respectively, of the final product. Oxidation takes place in a significantly decreasing fashion over time. That is, at early times during the heating process, the oxidation rate is relatively high, but decreases significantly as the process continues. This is consistent with the diffusional oxidation mechanism believed to occur, since the length of the diffusion path for iron atoms would increase over time. The quantitative rate of hematite formation varies with factors such as the heating regime, and details of the iron-containing structure design, such as foil thickness, and cell size. For example, when an iron-containing structure made from flat and corrugated 0.1 mm thick plain steel foils, and having large cells as described above, is heated at about 850° C., more than forty percent of the iron can be oxidized in one hour. For such a structure, more than sixty percent of the iron can be oxidized in about four hours, while it can take about 100 hours for total (substantially 100 percent) oxidation of iron to hematite.

Impurities in the steel starting structures, such as P, Si, and Mn, may form solid oxides which slightly contaminate the final iron oxide structure. Further, the use of an asbestos insulating layer in the process of the invention can also introduce impurities in the iron oxide structure. Factors such as these can lead to an actual weight gain slightly more than the theoretical weight gain of 30.05 percent or 27.64 percent, respectively, for formation of hematite and magnetite. Incomplete oxidation can lead to a weight gain less than the theoretical weight gain of 30.05 percent or 27.64 percent, respectively, for formation of hematite and magnetite. Also, when magnetite is formed by de-oxidizing hematite, incomplete de-oxidation of hematite can lead to a weight gain of greater than 27.64 percent for formation of magnetite. Therefore, for practical reasons, the terms iron oxide structure, hematite structure, and magnetite structure, as used herein, refer to structures consisting substantially of iron oxide, hematite, and magnetite, respectively.

Oxygen content and x-ray diffraction spectra can provide useful indicators of formation of iron oxide structures of the invention from iron-containing structures. In accordance with this invention, the term hematite structure encompasses structures which at room temperature are substantially nonmagnetic and substantially nonconductive electrically, and contain greater than about 29 weight percent oxygen. Typical x-ray diffraction data for hematite powder are shown in Table IV in Example 1 below. Magnetite structure refers to structures which at room temperature at magnetic and electrically conductive and contain about 27 to about 29 weight percent oxygen. If magnetite is formed by de-oxidation of hematite, hematite can also be present in the final structure as seen, for example in the x-ray data illustrated in Table V in Example 2 below. Depending on the desired characteristics and uses of the final product, de-oxidation can proceed until sufficient magnetite is formed.

It may be desirable to approach the stoichiometric oxygen content in the iron oxide present in the final structure. This can be accomplished by controlling such factors as heating rate, heating temperature, heating time, air flow, and shape of the iron-containing starting structure, as well as the choice and handling of an insulating layer.

Hematite formation preferably is brought about by heating a plain steel material at a temperature less than the melting point of iron (about 1536° C.), more preferably at a temperature less than about 1350° C., and even more preferably at a temperature of about 750 to about 1200° C. In one particularly preferred embodiment, plain steel can be heated at a temperature between about 80 and about 850° C. The time for heating at such temperatures preferably is about 3 to 4 days. In another preferred embodiment, plain steel can be heated at a temperature between about 925 and about 975° C., and most preferably at about 950° C. The time for heating at such temperatures preferably is about 3 days. In another preferred embodiment, plain steel can be heated at a temperature between about 1100 and about 1150° C., and more preferably at about 1130° C. The time for heating at such temperatures preferably is about 1 day. Oxidation at temperatures below about 700° C. may be too slow to be practical in some instances, whereas oxidation or iron to hematite at temperatures above about 1350° C. may require careful control to avoid localized overheating and melting due to the strong exothermicity of the oxidation reaction.

The temperature at which iron is oxidized to hematite is inversely related to the surface area of the product obtained. For example, oxidation at about 750 to about 850° C. can yield a hematite structure having a BET surface area about four times higher than that obtained at 1200° C.

A suitable and simple furnace for carrying out the heating is a conventional convection furnace. Air access in a conventional convection furnace is primarily from the bottom of the furnace. Electrically heated metallic elements can be employed around the structure to be heated to provide relatively uniform heating to the structure, preferably within about 1° C. In order to provide a relatively uniform heating rate, an electronic control panel can be provided, which also can assist in providing uniform heating to the structure. It is not believed that any particular furnace design is critical so long as an oxidative environment and heating to the desired temperature are provided to the starting material.

The starting structure can be placed inside a jacket which can serve to fix the outer dimensions of the structure. For example, a cylindrical disk can be placed inside a cylindrical quartz tube which serves as a jacket. If a jacket is used for the starting structure, an insulating layer preferably is disposed between the outer surface of the starting structure and the inner surface of the jacket. The insulating material can be any material which serves to prevent the outer surface of the iron oxide structure formed during the oxidation process from bonding to the inner surface of the jacket. Asbestos and zirconium foils are suitable insulating materials. Zirconium foils, which can form easily removable zirconia ($ZrO_2$) powders during processing, are preferred.

For ease in handling, the starting structure may be placed into the furnace, or heating area, while the furnace is still cool. Then the furnace can be heated to the working temperature and held for the heating period. Alternatively, the furnace or heating area can be heated to the working temperature, and then the metal starting structure can be placed in the heating area for the heating period. The rate at which the heating area is brought up to the working temperature is not critical, and ordinarily will merely vary with the furnace design. For formation of hematite using a convection furnace at a working temperature of about 790° C., it is preferred that the furnace is heated to the working temperature over a period of about 24 hours, a heating rate of approximately 35° C. per hour.

The time for heating the structure (the heating period) varies with such factors as the furnace design, rate of air (oxygen) flow, and weight, wall thickness, shape, size, and open cross-section of the starting material. For example, for formation of hematite from plain steel foils of about 0.1 mm thickness, in a convection furnace, a heating time of less than about one day, and most preferably about 3 to about 5 hours, is preferred for cylindrical disk structures about 20 mm in diameter, about 15 mm high, and weighing about 5 grams. For larger samples, heating time should be longer. For example, for formation of hematite from such plain steel foils in a convection furnace, a heating time of less than about ten days, and most preferably about 3 to about 5 days, is preferred for disk structures about 95 mm in diameter, about 70 mm high, and weighing up to about 1000 grams.

After heating, the structure is cooled. Preferably, the heat is turned off in the furnace and the structure simply is permitted to cool inside the furnace under ambient conditions over about 12 to 15 hours. Cooling should not be rapid, in order to minimize any adverse effects on integrity and mechanical strength of the iron oxide structure. Quenching the iron oxide structure ordinarily should be avoided.

Hematite structures of the invention have shown remarkable mechanical strength, as can be seen in Tables III VI, VII and VIII in the Examples below. For hematite structures shaped as flow dividers, structures having smaller cell size and larger wall thickness exhibit the greatest strength. Of these two characteristics, as can be seen in Tables III and VI, the primary strength enhancement appears to stem from cell size, not wall thickness. Therefore, hematite structures of the invention are particularly desirable for use as light flow dividers having a large open cross-section.

A particularly advantageous application of monoliths of the invention is as a ceramic support in automotive catalytic converters. A current industrial standard of the support is a cordierite flow divider with closed cells having, without washcoating, a wall thicknesses of about 0.17 mm, an open cross-section of 65 percent, and a limiting strength of about 0.3 MPa. P. D. Stroom et al., SAE Paper 900500, pgs. 40–41, "Recent Trends in Automotive Emission Control," SAE (February 1990). As can be seen in Tables I and III below, the present invention can be used to manufacture a hematite flow divider having thinner walls (approximately 0.07 mm), higher open cross-section (approximately 80 percent), and twice the limiting strength (approximately 0.5 to about 0.7 MPa) as compared to the cordierite product. Hematite flow dividers having thin walls, such as for example, 0.07 to about 0.3 mm may be obtained with the present invention.

To provide necessary mechanical strength, ceramic supports, particularly including cordierite, have a closed-cell design. As explained below, the metal oxide supports of the present invention may have either a closed or open-cell design. Since open-cell designs possess preferable flow characteristics such as greater open cross-sectional area and geometric surface area per unit volume, as discussed in more detail below, they are preferred for applications where such flow characteristics are desired.

The preferred method of forming magnetite structures of the invention comprises first transforming an iron-containing structure to hematite, as described above, and then de-oxidizing the hematite to magnetite. A simple de-oxidative atmosphere is air. Alternate useful de-oxidative atmospheres are nitrogen-enriched air, pure nitrogen, or any proper inert gas. A vacuum can be particularly useful in the process since it can decrease the working temperature required to carry out deoxidation. The presence of a reducing agent, such as carbon monoxide, can assist in efficiency of the de-oxidation reaction.

Following the oxidation of a starting iron-containing structure to hematite, the hematite can be de-oxidized to magnetite by heating in air at about 1350° C. to about 1550° C., or preferably in a light vacuum at lower temperatures, preferably about 1250° C. The preferred pressure is about 0.001 atmospheres. Lower pressures may desirably permit de-oxidation at lower temperatures, but undesirably lowers the melting point of magnetite. Melting the metal oxide should be avoided.

Optionally, after heating to form a hematite structure, the structure can be cooled, such as to a temperature at or above room temperature, as desired for practical handling of the structure, prior to de-oxidation of hematite to magnetite. Alternatively, the hematite structure need not be cooled prior to de-oxidation to magnetite.

For de-oxidation of hematite to magnetite, the most preferred process involves heating at about 1250° C. and about 0.001 atmospheres, followed by cooling under vacuum. During the heating process, the vacuum may drop and then is gradually restored. It is believed that the vacuum drop is due to extensive evolution of oxygen as hematite is transformed to magnetite. Ambient oxygen is irreversibly removed by the vacuum from the processing environment in order to minimize re-transformation of magnetite to hematite.

The heating time sufficient to de-oxidize hematite to magnetite generally is much shorter than the period sufficient to oxidize the material to hematite initially. Preferably, for use of hematite structures as described above, the heating time for de-oxidation to magnetite structures in air at about 1450° C. is less than about twenty-four hours, and in most cases is more preferably less than about six hours in order to form structures containing suitable magnetite. A heating time of less than about one hour for de-oxidation in air may be sufficient in many instances. For de-oxidation in a vacuum, the preferred heating time is shorter. For a pressure of about 0.001 atmospheres, at 1000 to 1050° C. the desired de-oxidation preferably takes about 5 to 6 hours; at 1200° C., de-oxidation preferably takes about 2 hours; at 1250° C., de-oxidation preferably takes about 0.25 to 1 hour; at 1350° C., the structure has been found to melt down. The most preferred heating time for de-oxidation is about 15 to 30 minutes.

Magnetite structures also can be formed directly from iron-containing structures by heating iron-containing structures in an oxidative atmosphere. To avoid a substantial presence of hematite in the final product, the preferred working temperatures for a direct transformation of iron-containing structures to magnetite in air are about 1350 to about 1500° C. Since the oxidation reaction is strongly exothermic, there is a significant risk that the temperature in localized areas can rise above the iron melting point of approximately 1536° C., resulting in local melts of the structure. Since the de-oxidation of hematite to magnetite is endothermic, unlike the exothermic oxidation of steel to magnetite, the risk of localized melts is minimized if iron is first oxidized to hematite and then de-oxidized to magnetite. Thus, formation of a magnetite structure by oxidation of an iron-containing structure to a hematite structure at a temperature below about 1200° C., followed by de-oxidation of hematite to magnetite, is the preferred method.

Thin-walled iron-oxide structures of the invention can be used in a wide variety of applications. The relatively high open cross-sectional area which can be obtained can make the products useful as catalytic supports, filters, thermal insulating materials, and sound insulating materials.

Iron oxides of the invention, such as hematite and magnetite, can be useful in applications such as gaseous and liquid flow dividers; corrosion resistant components of automotive exhaust systems, such as mufflers, catalytic converters, etc.; construction materials (such as pipes, walls, ceilings, etc.); filters, such as for water purification, food products, medical products, and for particulates which may be regenerated by heating; thermal insulation in high-temperature environments (such as furnaces) and/or in chemically corrosive environments; and sound insulation. Iron oxides of the invention which are electrically conductive, such as magnetite, can be electrically heated and, therefore, can be applicable in applications such as electrically heated thermal insulation, electric heating of liquids and gases passing through channels, and incandescent devices. Additionally, combination structures using both magnetite and hematite can be fabricated. For example, it should be possible for the materials of the invention to be combined in a magnetite heating element surrounded by hematite insulation.

A particularly preferred structure which can be obtained according to the invention is a metal oxide flow divider having an open-celled "cor-cor" design, such as is depicted in FIGS. 4 to 7. As used herein, an open-cell flow divider is a flow divider where some or all of the individual flow streams are in communication with other streams within the divider. A closed-cell flow divider refers to a flow divider where no individual flow streams are in communication with any other streams within the divider. A cor-cor structure is an open-cell structure created by placing two or more corrugated layers adjacent to one another in a manner where nesting of the layers is partially or completely avoided.

Generally, many bodies, such as flow dividers, catalytic carriers, mufflers, etc. have a cellular structure with channels going through the body. The cells may be either closed or open, and the channels may be either parallel or non-parallel. For demanding environments such as elevated temperatures and oxidative/corrosive atmospheres, the known body materials typically are limited to refractory metallic alloys and/or ceramics. Metallic materials used as thin foils allow one to fabricate bodies with a great variety of forms where the density of cells and their shapes can also vary greatly. By contrast, for ceramic materials, which are currently obtained generally by extrusion and sintering of powders, the variety of structures is very limited.

A body having closed cells and parallel channels, which allows only axial mass flow, is a simple, common monolithic body used in previous designs. The design is particularly appropriate for extrusion technology used with ceramics to date. For metallic bodies, this closed cell, parallel channel design is commonly realized by winding together two alternate metal sheets, one flat and one corrugated. In this "flat-cor" or "cor-flat" design, the flat sheets simply serve to separate the corrugated ones to prevent "nesting" of adjacent corrugated sheets but otherwise is unnecessary and indeed results in a loss of open cross-sectional area. In some instances, this problem has been addressed by using alternate sheets with different corrugations, in particular one of the sheets might be partially flat and partially corrugated.

It has now been found that ceramic metal oxide open cells bodies can be manufactured according to the present invention by first forming an open cell metal-containing body, and then transforming the metal to metal oxide according to the processes disclosed herein. Open cell bodies according to the invention need not have flat sheets, and may consist only of a plurality of adjacent corrugated layers. If desired, additional flat sheets also can be added.

One embodiment of the "cor-cor" ceramic bodies of the invention, comprising adjacent corrugated layers with no flat sheets therebetween, are particularly well-suited to applications where it is desirable to reduce the body weight (bulk density) of the material, and provide both axial and radial mass and heat flow, such as, for example, in automotive catalytic converters. Other desirable aspects of the ceramic cor-cor bodies of the invention include:

1) sufficiently large open cross-sectional area and geometric surface area, leading to smaller body size and to a lower pressure drop than in closed cell arrangements of comparable weight;

2) for comparable weights and open cross-sectional areas, the wall thickness and/or cell density may be higher, resulting in increased mechanical strength of the cor-cor body as compared to closed cell designs;

3) a more uniform distribution of temperature, reducing thermal stresses during thermal cycling than in closed cell designs;

4) better washcoating, since in closed cell substrates, the washcoat slurry can undesirably fill in corners of the cells, mainly due to surface tension effects.

FIG. 4 depicts a top view of a preferred open cell ceramic structure 10 of the invention. Structure 10 is suitable for use as a flow divider for dividing a fluid stream f, which flows parallel to side 30 of structure 10. FIG. 4 depicts a structure having a first corrugated layer having peaks 40 of generally triangular cells. The cells form generally parallel channels, as shown by the parallel nature of peaks 40. The channels having peaks 40 of the first corrugated layer are positioned at an angle α to the axis f of fluid flow. A second corrugated layer, positioned below the first corrugated layer, has peaks 50 (represented by dashed lines) of generally triangular cells. The cells form generally parallel channels, as shown by the parallel nature of peaks 50. The channels having peaks 50 of the second corrugated layer are positioned at an angle 2α to the channels having peaks 40 of the first corrugated layer. It should be understood that structure 10 may be provided with as many corrugated metal layers as is desired for the final metal oxide product, and that FIG. 4 merely depicts two layers for convenience.

It is preferred that additional corrugated layers are positioned above and below the first and second corrugated layers. In a preferred embodiment, channels in alternating layers are positioned at an angle 2α with respect to one another, although this arrangement need not be repeated for every alternating layer. Any suitable arrangement which prevents nesting of adjacent corrugated layers may be employed. The corrugated metal layers may be formed by any suitable methods, including rolling a flat sheet with a tooth roller. It is preferred to employ a tooth roller which rolls a flat sheet at an angle desired to be equal to angle α in the resulting cor-cor structure.

Figure 5:
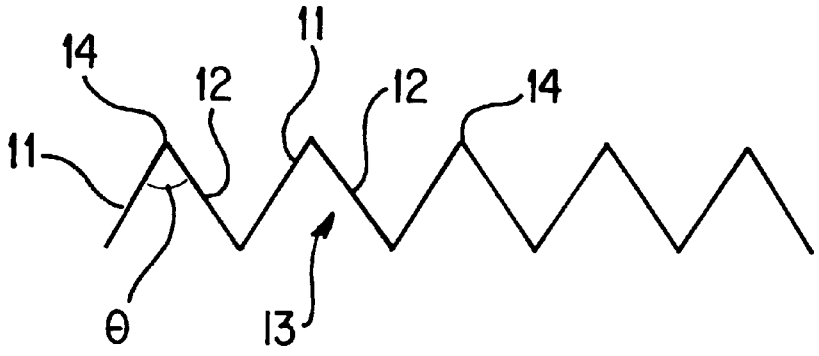
FIG. 5 is a side view of a corrugated layer suitable for use in metal oxide structures of the invention.

FIG. 5 depicts a side view of a corrugated layer suitable for use in the invention. Sides 11 and 12 of triangular cells are joined at an apex 14 and lie at an angle θ to each other. Channels 13, running perpendicular to the plane of the page depicting FIG. 5, are formed by sides 11 and 12, and are suitable for receiving fluid flow in structures such as those depicted in FIGS. 4 and 7.

Figure 6:
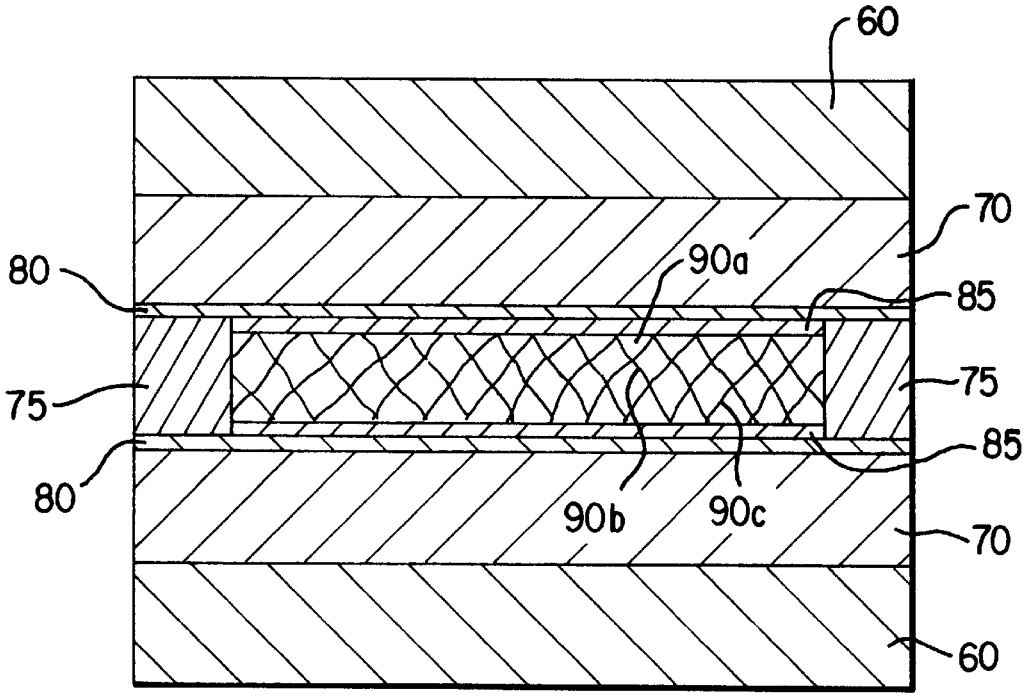
FIG. 6 is a side view of an assembly suitable for processing metal structures according to processes of the invention.

FIG. 6 depicts a side view of an assembly containing a cor-cor structure suitable for heat treatment according to the invention. Corrugated metal sheets 90*a*, 90*b*, and 90*c* are stacked in the manner described above and depicted in FIG. 4. As discussed above, the structure may be provided with as many corrugated metal layers as is desired for the final metal oxide structure, with three layers depicted for convenience in FIG. 6. Top and bottom flat metal sheets 85 are positioned above and below the top and bottom corrugated sheets, respectively. Insulating layers 80, preferably comprise asbestos or zirconium foils, are positioned above and below flat sheets 85. Plates 60 and 70, preferably comprising alumina, are stacked above and below the insulation layers 80 to apply pressure to the cor—cor structure to assist in maintaining close proximity of the surfaces of the corrugated layers with respect to one another.

Blocks (or cores) 75, which preferably comprise alumina, are positioned between top and bottom insulation layers 80. Blocks 75 preferably have a height slightly less than the height of the cor—cor metal-containing structure (including its corrugated layers 90*a*, 90*b*, and 90*c*, and top and bottom flat layers 85). Thus, blocks 75 serve to fix the height of the final cor—cor metal oxide structure by preventing the pressure from plates 60 and 70 from reducing the cor—cor structure height to less than that of the blocks 75. The entire structure in FIG. 6 is designed to be placed in a heating environment, such as a furnace, for transforming the metal in layers 85, 90*a*, 90*b* and 90*c* to metal oxide, in accordance with processes described herein.

A similar structure as that depicted in FIG. 6 can be employed for metal preforms made with other shapes or metal components. For example, a metal oxide filter could be formed from metal filaments which are positioned in place of corrugated layers 90*a*, 90*b*, 90*c* in an assembly similar to that shown in FIG. 6. Top and bottom metal sheets 85 may be eliminated if not desired for the final product.

Figure 7:
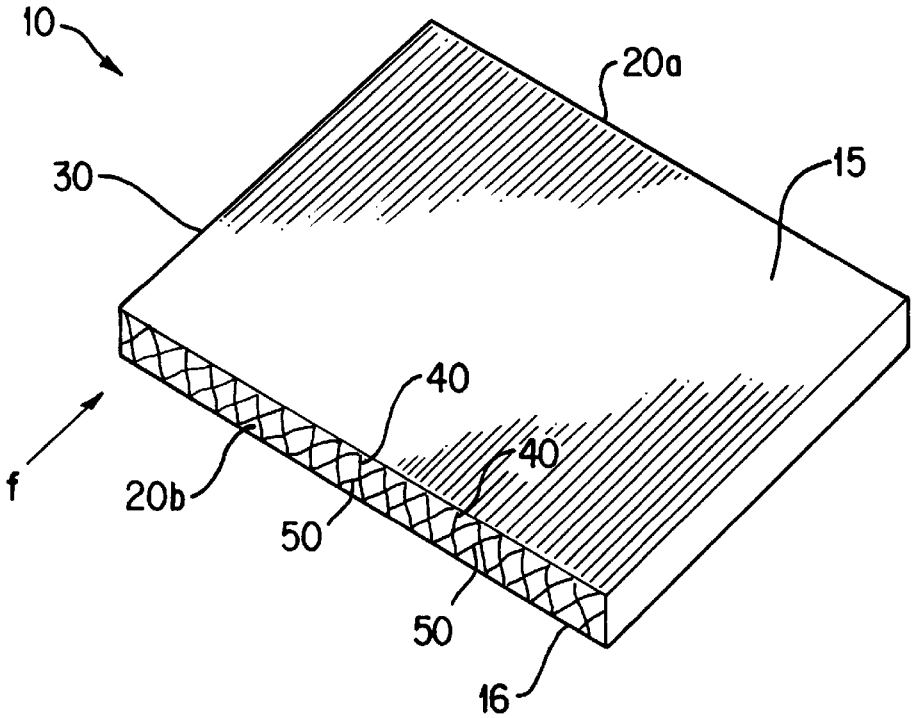
FIG. 7 is a plan view of the structure depicted in FIG. 4.

FIG. 7 shows a plan view of the brick cor—cor structure depicted in FIGS. 4 to 6. Again, two corrugated layers are depicted simply for convenience. Flat top sheet 15 lies above the peaks 40 of the first corrugated layer. A flat bottom sheet 16 lies below the troughs of the bottom corrugated layer.

In order to prevent nesting of the corrugated layers of cor—cor structures of the invention, the adjacent layers preferably are stacked while mirror-reflected, so that the channels of adjacent layers intersect at the angle 2α. The angle α, which is larger than zero, may vary up to 45°. Thus, the angle 2α varies up to 90°. As shown in Example 4 below, the mechanical strength of the body is related to α.

Another parameter of the cor—cor structure which can affect its mechanical properties, is the angle θ of the triangular cell. Angle θ is 60° in an equilateral triangle, and may be smaller or larger than 60° in isosceles triangles. The values of θ greater than 60°, particularly around 90° usually correspond to mechanically stronger bodies than values of θ less then 60°.

Corrugated sheets used in the cor—cor design of the present invention preferably have equilateral or isosceles triangular cells (θ>60°) with a cell density of about 250 to about 1000 cells per square inch (cpsi). The thickness of preferred metal foils used in cor—cor structures of the invention is about 0.025 to 0.1 mm. A foil thickness of about 0.038 mm is preferred for iron-containing structures used to make flow dividers. A foil thickness of about 0.05 mm is preferred for structures employing metals other than iron.

For better protection and safer handling of corrugated layers of the metal oxide structure, it is preferable to provide outermost top and bottom layers made from relatively thicker, flat metal foil to a metal cor—cor preform. In the case of an iron-containing preform, a steel foil having a thickness of about 0.1 mm is preferred.

As discussed above, in a preferred embodiment, the corrugated sheets are cut into pieces which are stacked while mirror-reflected, to form a desired cross-section. If the stacked pieces are identical rectangles, the resulting cross-section is substantially rectangular. However, if desired, stacked metal pieces may be cut or shaped so that the resulting cross-section is round, oval, or another desired shape, and then transformed to metal oxide. In general, any desired shape which can be obtained as a thin-walled metal body can be transformed into a ceramic body according to the invention.

Another alternative for making ceramic cor—cor bodies of a desired shape is to make a ceramic metal oxide body with a rectangular cross-section ("brick") form a proper metal preform, and then cut this ceramic brick into the desired shape. For example, a brick 10 as depicted in FIGS. 4 to 7 may be transformed to a metal oxide structure, and then cut into a cylindrical shape whose top and bottom correspond to sides 20*a* and 20*b* of brick 10. The axis of the cylinder is parallel to flow axis f. Exemplary preferred details and material properties of the cor—cor bodies such as these are given in Examples 4 and 5. For better protection of the cylindrical structure, after the brick is cut, a flat metal sheet can be wound around the circumference of the cylinder, and the entire structure can then be heat treated according to the processes disclosed herein to form a monolithic metal oxide structure.

It has also been found that the processes of the invention can be employed to manufacture unitary structures which can serve as filters. In preferred embodiments, refractory filters having sufficient mechanical strength, dimensional stability, and the ability to collect and separate various objects (such as particulates) from a flow can be obtained according to the invention. Exemplary filters obtained in this aspect of the invention have a high void volume, preferably greater than about 70 percent, and more preferably about 80 to about 90 percent. Such filters can be made, for example, by transforming metal felts, textiles, wools, etc. into metal oxide filters by heating according to the processes described herein. Preferably, the individual wires which make up the felt or textile have a wire filament diameter of about 10 to about 100 microns.

In a preferred embodiment, thin shavings made from plain steels, such as Russian steel 3, AISI-SAE 1010 steel, or others used in the thin foils described above, having a nonuniform thickness are formed into felts. The shavings density can be varied depending on the filter density desired for the final product. The felts are then transformed by heating at a temperature below the melting point of iron to transform the iron into iron oxide, preferably hematite. Preferably, additional heat treatment also is undertaken to close internal voids or holes in the filaments, and otherwise improve the uniformity and physical properties of the material, such as the mechanical strength, as discussed above. The filter may be further strengthened by incorporating various reinforcing elements made of steel into the filter body, preferably at the outset in a steel preform. Exemplary reinforcing elements are steel gauzes, steel screens, and steel wools, with filaments of varying thickness. Finally, the hematite filter may be transformed into a magnetite filter under conditions described above for the hematite to magnetite transformation for thin-walled structures. Various details of manufacturing and properties of exemplary high void volume filters are given in Example 7 and 8.

Complex shapes can also be built in accordance with the invention, due to the discovery that two or more metal oxide structures can be fused together, even if the starting structures are dissimilar. For example, placing steel material between two or more hematite pieces, and then processing the sample to transform the iron in the steel to iron oxide, by heating at a temperature below the melting point of iron (as described herein), can bond the hematite pieces together. The steel bonding material can be in the form of, for example, a thin foil, screen, gauze, shavings, dust, or filaments. Where large open areas for fluid flow are desired, bonding two or more structures generally is not preferred since it prevents flow through the bonded surfaces. Bonding is preferred for materials which are used as insulators.

In addition to transforming iron to iron oxide, the processes described herein can be utilized to transform other metals to metal oxides. For example, nickel, copper or titanium-containing structures can be transformed to structures containing their corresponding oxides by heating the structure to a temperature below the melting point ($T_m$) of the metal.

For structures containing nickel ($T_m$=1455° C.), heating preferably is at temperatures below about 1400° C., more preferably between about 900 and about 1200° C., and most preferably between about 950 and about 1150° C. A preferred atmosphere is air. The heating time can vary depending on processing conditions, heating temperature, reaction conditions, furnace, structure to be treated, final product desired, etc. A preferred heating time is for about 96 to about 120 hours, as illustrated in Example 6.

For structures containing copper ($T_m$=1085° C.), heating preferably is at temperatures below about 1000° C., more preferably between about 800 and about 1000° C., and most preferably between about 900 and about 950° C. A preferred atmosphere is air. The heating time can vary depending on processing conditions and desired oxidation state of copper. Preferably, heating is for about 48 to about 168 hours, depending on the temperature, reaction conditions, furnace, structure to be treated, final product desired, etc. It is believed that processing at lower temperatures and/or for shorter times results in formation of a greater proportion of $Cu_2O$ than CuO in the final structure. For formation of a structure containing substantially complete transformation to CuO, a preferred process is heating at about 950° C. for about 48 to about 72 hours, as illustrated in Example 6.

For structures containing titanium ($T_m$=1660° C.), heating preferably is at temperatures below about 1600° C., more preferably between about 900 and about 1200° C., and most preferably between about 900 and about 950° C. A preferred atmosphere is air. The heating time can vary depending on processing conditions, heating temperature, reaction conditions, furnace, structure to be treated, final product desired, etc. A preferred heating time at about 950° C. is for about 48 to about 72 hours, as illustrated in Example 6.

In summary, the processes of the invention can obtain thin-walled monolithic metal oxide structures from metals. The heat treatments and the resulting structures for different metals have similar patterns but with important individual features. The best controlled and most economical processes allow one to obtain a metal oxide structure with the metal in its highest oxidation state. Very high and very low working temperatures generally are less desirable. Although higher temperatures are effective for faster and more complete (stoichiometric) oxidation of a metal to its highest oxidation state, these conditions can be detrimental to the quality of the resulting thin-walled metal oxide materials if conducted too close to the melting point of the metal, since the oxidation reaction is highly exothermic and can increase the temperature above the melting point of the metal. Therefore, one should be sufficiently below the metal melting point to prevent overheating and melting the structure.

If the temperatures are too low, even a long heating time likely will result in incomplete oxidation. This can, in principle, be rectified by additional heat treatment to oxidize the residual metal and lower metal oxides. However, because the residual metals typically will have thermal characteristics (expansion coefficient, conductivity, etc.) different from those of the desired oxide, an extra heat treatment may damage the thin-walled oxide structure. Extra heat treatments are less favored where the final metal oxide has more than one stable structural modification for a particular stoichiometry, so that the final structure may not be uniform, which typically can be detrimental to its mechanical strength. Iron-containing structure, with only one structure for hematite ($Fe_2O_3$), typically are affected favorably by an extra heat treatment. Thus, such iron-containing structures are most favorable in this respect and can usually be improved by repeated heating. Other metals may be more difficult to handle. In particular, for titanium, which has several modifications of the dioxide $TiO_2$ (rutile, anatase, and brookite), an extra heat treatment of an oxide structure can actually be detrimental to the oxide structure.

Thus, the most preferred temperature ranges are those below the metal melting point which are high enough to promote relatively rapid and complete oxidation, while avoiding overheating of the structure to a temperature above the metal melting point during processing.

The following examples are illustrative of the invention.

EXAMPLE 1

Monolithic hematite structures in the shape of a cylindrical flow divider were fabricated by heating a structure made from plain steel in air, as described below. Five different steel structure samples were formed, and then transformed to hematite structures. Properties of the structures and processing conditions for the five runs are set forth in Table I.

TABLE I

FLOW DIVIDER PROPERTIES AND PROCESSING CONDITIONS

| | 1 | 2 | 3 | 4 | 5 |
|---|---|---|---|---|---|
| Steel Disk Diameter, mm | 92 | 52 | 49 | 49 | 49 |
| Steel Disk Height, mm | 76 | 40 | 40 | 40 | 40 |
| Steel Disk Vol., $cm^3$ | 505.2 | 84.9 | 75.4 | 75.4 | 75.4 |
| Steel foil thickness, mm | 0.025 | 0.1 | 0.051 | 0.038 | 0.025 |
| Cell base, mm | 2.15 | 1.95 | 2.00 | 2.05 | 2.15 |
| Cell height, mm | 1.07 | 1.00 | 1.05 | 1.06 | 1.07 |
| Steel wt., g | 273.4 | 162.0 | 74.0 | 62.3 | 46.0 |
| Steel sheet length, cm | 1714 | 446 | 450 | 458 | 480 |
| Steel area (one side), $cm^2$ | 13026 | 1784 | 1800 | 1832 | 1920 |
| Steel volume, $cm^3$ * | 34.8 | 20.6 | 9.4 | 7.9 | 5.9 |
| Steel disk open cross-section, % | 93 | 76 | 87 | 89 | 92 |
| Heating time, hr. | 96 | 120 | 96 | 96 | 96 |
| Heating temp., ° C. | 790 | 790 | 790 | 790 | 790 |
| Hematite wt., g | 391.3 | 232.2 | 104.3 | 89.4 | 66.1 |
| Hematite weight gain, wt. % | 30.1 | 30.2 | 29.1 | 30.3 | 30.3 |
| Typical actual hematite thickness, mm | 0.072 | 0.29 | 0.13 | 0.097 | 0.081 |
| Typical hematite gap, mm | 0.015 | 0.04 | 0.02 | 0.015 | 0.015 |
| Typical hematite thickness without gap, mm | 0.057 | 0.25 | 0.11 | 0.082 | 0.066 |
| Hematite vol. without gap, $cm^3$ * | 74.6 | 44.3 | 19.9 | 17.1 | 12.6 |
| Actual hematite vol. with gap, $cm^3$ ** | 93.8 | 51.7 | 23.4 | 20.1 | 15.6 |
| Hematite structure open cross-section without gap, % | 85 | 48 | 73 | 77 | 83 |
| Actual open cross-section with gap, % | 81 | 39 | 69 | 73 | 79 |

* Calculated from the steel or hematite weight using a density of 7.86 $g/cm^3$ for steel and 5.24 $g/cm^3$ for hematite

** Calculated as the product of (one-sided) steel geometric area times actual hematite thickness (with gap)

Details of the process carried out for Sample 1 are given below. Samples 2 to 5 were formed and tested in a similar fashion.

For Sample 1, a cylindrical flow divider similar to that depicted in FIG. 1, measuring about 92 mm in diameter and 76 mm in height, was constructed from two steel sheets, each 0.025 mm thick AISI-SAE 1010, one flat and one corrugated. The corrugated sheet of steel had a triangular cell, with a base of 2.15 mm and a height of 1.07 mm. The sheets were wound tightly enough so that physical contact was made between adjacent flat and corrugated sheets. After winding, an additional flat sheet of steel was placed around the outer layer of the structure to provide ease in handling and added rigidity. The final weight of the structure was about 273.4 grams.

The steel structure was wrapped in an insulating sheet of asbestos approximately 1 mm thick, and tightly placed in a cylindrical quartz tube which served as a jacket for fixing the outer dimensions of the structure. The tube containing the steel structure was then placed at room temperature on a ceramic support in a convention furnace. The ceramic support retained the steel sample at a height in the furnace which subjected the sample to a uniform working temperature varying by no more than about 1° C. at any point on the sample. Thermocouples were employed to monitor uniformity of sample temperature.

After placing the sample in the furnace, the furnace was heated electrically for about 22 hours at a heating rate of about 35° C. per hour, to a working temperature of about 790° C. The sample was then maintained at about 790° C. for about 96 hours in an ambient air atmosphere. No special arrangements were made to affect air flow within the furnace. After about 96 hours, heat in the furnace was turned off, and the furnace permitted to cool to room temperature over a period of about 20 hours. Then, the quartz tube was removed from the furnace.

The iron oxide structure was separated easily from the quartz tube, and traces of the asbestos insulation were mechanically removed from the iron oxide structure by abrasive means.

The structure weight was about 391.3 grams, corresponding to a weight gain (oxygen content) of about 30.1 weight percent. The very slight weight increase above the theoretical limit of 30.05 percent was believed to be due to impurities which may be resulted from the asbestos insulation. X-ray diffraction spectra for a powder made from the structure demonstrated excellent agreement with a standard hematite spectra, as shown in Table IV. The structure generally retained the shape of the steel starting structure, with the exception of some deformations of triangular cells due to increased wall thickness. In the hematite structure, all physical contacts between adjacent steel sheets were internally "welded," producing a monolithic structure having no visible cracks or other defects. The wall thickness of the hematite structure was about 0.07 to about 0.08 mm, resulting in an open cross-section of about 80 percent, as shown in Table I. In various cross-sectional cuts of the structure, which as viewed under a microscope each contained several dozen cells, an internal gap of about 0.01 to about 0.02 mm could almost always be seen. The BET surface area was about 0.1 $m^2$/gram.

The hematite structure was nonmagnetic, as checked against a common magnet. In addition, the structure was not electrically conductive under the following test. A small rod having a diameter of about 5 mm and a length of about 10 mm was cut from the structure. The rod was contacted with platinum plates which served as electrical contacts. Electric power capable of supplying about 10 to about 60 watts was applied to the structure without any noticeable effect on the structure.

The monolithic hematite structure was tested for sulfur resistance by placing four samples from the structure in sulfuric acid (five and ten percent water solutions) as shown below in Table II. Samples 1 and 2 included portions of the outermost surface sheets. It is possible that these samples contained slight traces of insulation, and/or were incompletely oxidized when the heating process was ceased. Samples 3 and 4 included internal sections of the structure only. With all four samples, no visible surface corrosion of the samples was observed, even after 36 days in the sulfuric acid, and the amount of iron dissolved in the acid, as measured by standard atomic absorption spectroscopy, was negligible. The samples also were compared to powder samples made from the same monolithic hematite structure, ground to a similar quality as that used for x-ray diffraction analyses, and soaked in $H_2SO_4$ for about twelve days. After another week of exposure (for a total of 43 days for the monolith samples and 19 days for the powder samples), the amount of dissolved iron remained virtually unchanged, suggesting that the saturation concentrations had been reached. Relative dissolution for the powder was higher due to the surface area of the powder samples being higher than that of the monolithic structure samples. However, the amount and percentage dissolution were negligible for both the monolithic structure and the powder formed from the structure.

TABLE II

RESISTANCE TO CORROSION FROM SULFURIC ACID

| | Sample 1 | Sample 2 | Sample 3 | Sample 4 |
|---|---|---|---|---|
| wt. $Fe_2O_3$, g | 14.22 | 16.23 | 13.70 | 12.68 |
| wt. Fe, g | 9.95 | 11.36 | 9.59 | 8.88 |
| % $H_2SO_4$ | 5 | 10 | 5 | 10 |
| wt Fe dissolved, mg, 8 days | 4.06 | 4.60 | 1.56 | 2.19 |
| wt Fe dissolved, mg, 15 days | 5.54 | 5.16 | 2.40 | 3.43 |
| wt Fe dissolved, mg, 36 days | 6.57 | 7.72 | 4.12 | 4.80 |
| total wt % Fe dissolved, 36 days | 0.066 | 0.068 | 0.043 | 0.054 |
| total wt % Fe dissolved, 12 days, from powder | 0.047 | 0.047 | 0.041 | 0.046 |

Based on the data given in Tables I and II for the monolithic structure, the average corrosion resistance for the samples was less than 0.2 mg/cm$^2$ hr, which is considered non-corrosive by ASM. ASM Engineered Materials Reference Book, ASM International, Metals Park, Ohio 1989.

Figure 3:
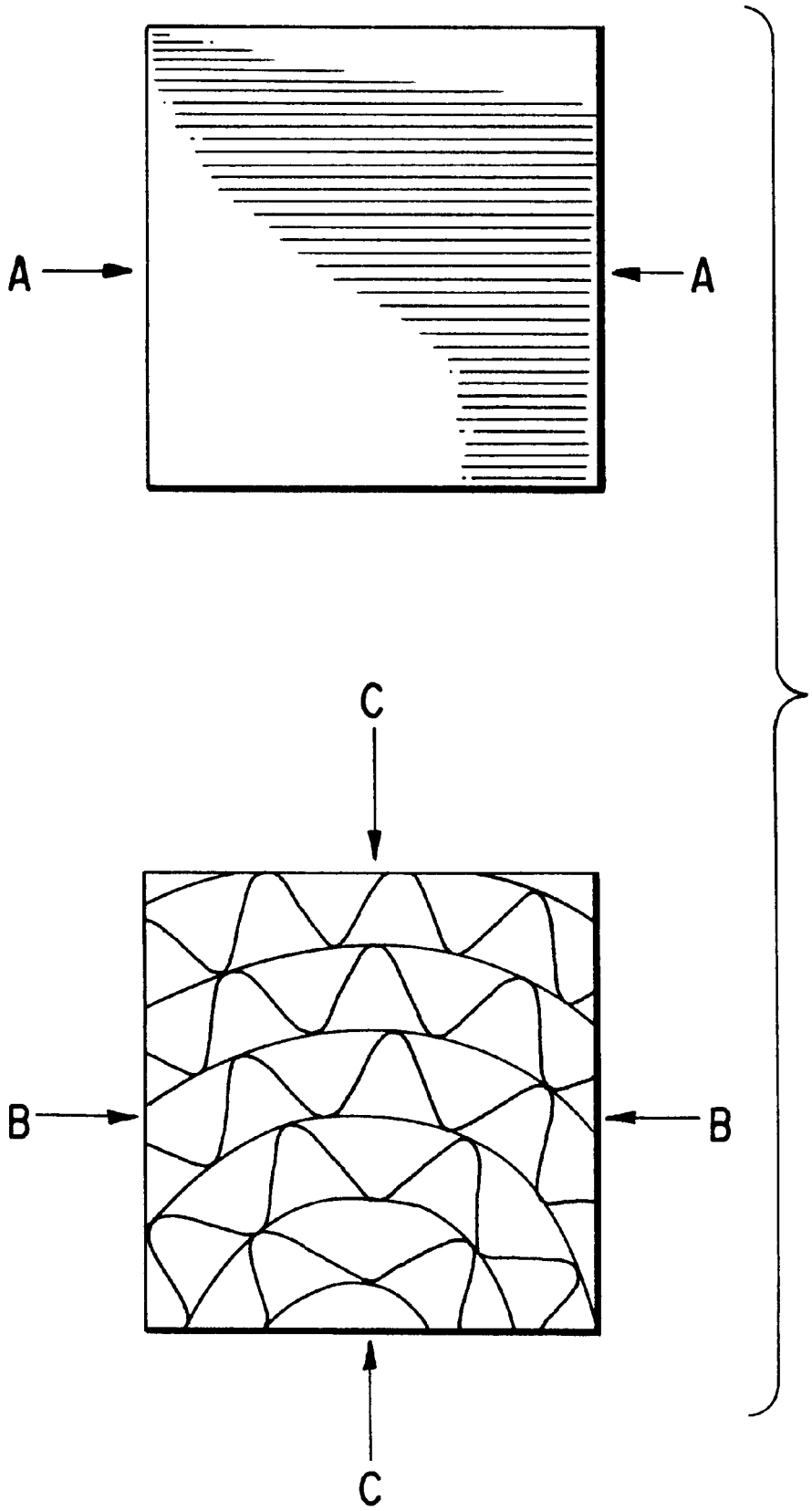
FIG. 3 is a schematic cross-sectional view of a cubic sample of an iron oxide structure shaped as a cylindrical flow divider, with the coordinate axes and direction of forces shown.

The hematite structure of the example also was subjected to mechanical crush testing, as follows. Seven standard cubic samples, each about 1"×1"×1" were cut by a diamond saw from the structure. FIG. 3 depicts a schematic cross-sectional view of the samples tested, and the coordinate axes and direction of forces. Axis A is parallel to the channel axis, axis B is normal to the channel axis and quasi-parallel to the flat sheet, and axis C is normal to the channel axis and quasi-normal to the flat sheet. The crush pressures are given in Table III.

TABLE III

MECHANICAL STRENGTH OF HEMATITE MONOLITHS

| SAMPLE | AXIS TESTED | CRUSH PRESSURE MPa |
|---|---|---|
| 1 | a | 24.5 |
| 2 | b | 1.1 |
| 3 | c | 0.6 |
| 4 | c | 0.5 |
| 5 | c | 0.7 |
| 6 | c | 0.5 |
| 7 | c | 0.5 |

Sample 4 from Table I also was characterized using an x-ray powder diffraction technique. Table IV shows the x-ray (Cu $K_\alpha$ radiation) powder spectra of the sample as measured using an x-ray powder diffractometer HZG-4 (Karl Zeiss), in comparison with standard diffraction data for hematite. In the Table, "d" represents interplanar distances and "J" represents relative intensity.

TABLE IV

X-RAY POWDER DIFFRACTION PATTERNS FOR HEMATITE

| SAMPLE | | STANDARD | |
|---|---|---|---|
| d, A | J, % | d, A* | J, %* |
| 3.68 | 19 | 3.68 | 30 |
| 2.69 | 100 | 2.70 | 100 |
| 2.52 | 82 | 2.52 | 70 |
| 2.21 | 21 | 2.21 | 20 |
| 1.84 | 43 | 1.84 | 40 |
| 1.69 | 52 | 1.69 | 45 |

*Data file 33-0664, The International Centre for Diffraction Data, Newton Square, Pa.

EXAMPLE 2

A monolithic magnetite structure was fabricated by de-oxidizing a monolithic hematite structure in air. The magnetite structure substantially retained the shape, size, and wall thickness of the hematite structure from which it was formed.

The hematite structure was made according to a process substantially similar to that set forth in Example 1. The steel foil from which the hematite flow divider was made was about 0.1 mm thick. The steel structure was heated in a furnace at a working temperature of about 790° C. for about 120 hours. The resulting hematite flow divider had a wall thickness of about 0.27 mm, and an oxygen content of about 29.3 percent.

A substantially cylindrical section of the hematite structure about 5 mm in diameter, about 12 mm long, and weighing about 646.9 milligrams was cut from the hematite flow divider along the axial direction for making the magnetite structure. This sample was placed in an alundum crucible and into a differential thermogravimetric analyzer TGD7000 (Sinku Riko, Japan) at room temperature. The sample was heated in air at a rate of about 10° C. per minute up to about 1460° C. The sample gained a total of about 1.2 mg weight (about 0.186%) up to a temperature of about 1180° C., reaching an oxygen content of about 29.4 weight percent. From about 1180° C. to about 1345° C., the sample gained no measurable weight. At temperatures above about 1345° C., the sample began losing weight. At about 1420°

C., a strong endothermic effect was seen on a differential temperature curve of the spectrum. At 1460° C., the total weight loss compared to the hematite starting structure was about 9.2 mg. The sample was kept at about 1460° C. for about 45 minutes, resulting in an additional weight loss of about 0.6 mg, for a total weight loss of about 9.8 mg. Further heating at 1460° C. for approximately 15 more minutes did not affect the weight of the sample. The heat was then turned off, the sample allowed to cool slowly (without quenching) to ambient temperature over several hours, and then removed from the analyzer.

The oxygen content of the final product was about 28.2 weight percent. The product substantially retained the shape and size of the initial hematite sample, particularly in wall thickness and internal gaps. By contrast to the hematite sample, the final product was magnetic, as checked by an ordinary magnet, and electrically conductive. X-ray powder spectra, as shown in Table V, demonstrated characteristic peaks of magnetite along with several peaks characteristics of hematite.

The structure was tested for electrical conductivity by cleaning the sample surface with a diamond saw, contacting the sample with platinum plates which served as electrical contacts, and applying electric power of from about 10 to about 60 watts (from a current of about 1 to about 5 amps, and a potential of about 10 to about 12 volts) to the structure over a period of about 12 hours. During the testing time, the rod was incandescent, from red-hot (on the surface) to white-hot (internally) depending on the power being applied.

Table V shows the x-ray (cu $K_\alpha$ radiation) powder spectra of the sample as measured using an x-ray powder diffractometer HZG-4 (Karl Zeiss), in comparison with standard diffraction data for magnetite. In the Table, "d" represents interplanar distances and "J" represents relative intensity.

TABLE V

X-RAY POWDER DIFFRACTION PATTERNS FOR MAGNETITE

| SAMPLE | | STANDARD | |
|---|---|---|---|
| d, A | J, % | d, A* | J, %* |
| 2.94 | 20 | 2.97 | 30 |
| 2.68** | 20 | | |
| 2.52 | 100 | 2.53 | 100 |
| 2.43 | 15 | 2.42 | 8 |
| 2.19** | 10 | | |
| 2.08 | 22 | 2.10 | 20 |
| 1.61 | 50 | 1.62 | 30 |
| 1.48 | 75 | 1.48 | 40 |
| 1.28 | 10 | 1.28 | 10 |

*Data file 19-0629, The International Centre for Diffraction Data, Newton Square, Pa.
**Peaks characteristic of hematite. No significant peaks other than those characteristic of either hematite or magnetite were observed.

EXAMPLE 3

Two hematite flow dividers were fabricated from Russian plain steel 3 and tested for mechanical strength. The samples were fabricated using the same procedures set forth in Example 1. The steel sheets were about 0.1 mm thick, and both of the steel flow dividers had a diameter of about 95 mm and a height of about 70 mm. The first steel structure had a triangular cell base of about 4.0 mm, and a height of about 1.3 mm. The second steel structure had a triangular cell base of about 2.0 mm, and a height of about 1.05 mm. Each steel structure was heated at about 790° C. for about five days. The weight gain for each structure was about 29.8 weight percent. The wall thickness for each of the final hematite structures was about 0.27 mm.

The hematite structures were subjected to mechanical crush testing as described in Example 1. Cubic samples as shown in FIG. 3, each about 1"×1"×1", were cut by a diamond saw from the structures. Eight samples were taken from the first structure, and the ninth samples was taken from the second structure. The crush pressures are shown in Table VI.

TABLE VI

MECHANICAL STRENGTH OF HEMATITE MONOLITHS

| SAMPLE | AXIS TESTED | CRUSH PRESSURE MPa |
|---|---|---|
| 1 | a | 24.0 |
| 2 | a | 32.0 |
| 3 | b | 1.4 |
| 4 | b | 1.3 |
| 5 | c | 0.5 |
| 6 | c | 0.75 |
| 7 | c | 0.5 |
| 8 | c | 0.5 |
| 9 | c | 1.5 |

EXAMPLE 4

A monolithic magnetite structure was fabricated by de-oxidizing a monolithic hematite structure in a vacuum. The magnetite structure substantially retained the shape, size, and wall thickness of the hematite structure from which is was formed.

The hematite structure was made as an open cell cor—cor flow divider shaped as a brick with a rectangular cross section, as shown in FIGS. 4 to 7. The corrugated steel foil from which the steel preform was made had a thickness of 0.038 mm, with angle 2α of about 26° and isosceles triangular cells having a 2.05 mm base and 1.05 mm height. The cell density was about 600 cells/in$^2$ (cpsi). Outermost flat top and bottom layers, made from 0.1 mm steel foils, were positioned above and below the corrugated layers. The steel preform brick was 5.7 inches long, 2.8 inches wide, and 1 inch high. The hematite structure was made by transforming the steel preform by heating the steel structure in a convection furnace at a working temperature of about 800° C. for about 96 hours. Flat thick alumina plates served as jackets with an asbestos insulating layer of 1.0 mm thick. The one inch sample height was fixed by proper alumina blocks, and additional alumina plates weighing about 10 to 12 lbs. were placed on top of the jacketed structure to provide additional pressure up to about 50 g/cm$^2$ to ensure close contacts between adjacent layers of the steel preform, as illustrated in FIG. 6.

The resulting hematite structure had an oxygen content of about 30.1 wt. % and a wall thickness of about 0.09 mm (or 3.5 mil). The resulting cell structure was 600/3.5 cpsi/mil. When viewed under a microscope, the walls had distinct internal gaps similar to those shown in FIG. 2.

The hematite structure was then cut into eight standard 1"×1"×" cubic samples using a diamond saw. Three of the cubic samples were tested for crush strength, as reported in Table VII. The other five cubic samples were placed in an electrically heated vacuum furnace at room temperature, and was heated at a working pressure of about 0.001 atmosphere at a rate of 8–9° C./min. for 2 to 3 hrs. to a temperature of about 1230° C. Then the heating rate was decreased to about 1° C./min until the temperature reached 1250° C. The samples were then held at 1250° C. for another 20 to 30 minutes. Then, the heating was turned off, and the furnace was permitted to cooled naturally for 10 to 12 hrs. to ambient temperature.

The resulting magnetite samples had an oxygen content of about 27.5 wt. % as determined by weight, and exhibited distinct magnetism using a common magnet. The magnetite products remained monolithic and retained the initial hematite shape. The product exhibited practically no internal gap when viewed under a microscope (at 30 to 50× magnification), and appeared microcrystalline. The product had silver color and was shiny.

The crush strength of magnetite obtained at 1250° C. was distinctly superior to that of hematite, typically by 30 to 100%, as seen in Table VII. Both hematite and magnetite structures were subjected to mechanical crush testing as described in Example 1. For each sample, three measurements were made for three successive layers, and the average is reported.

TABLE VII

| C-AXIS CRUSH STRENGTH (MPa) | |
|---|---|
| Hematite Samples | Magnetite Samples |
| 0.60 | 0.68 |
| 0.55 | 0.71 |
| 0.55 | 0.72 |
| | 0.75 |
| | 0 70 |

One of the magnetite samples was analyzed using a simple magnet, and determined to possess magnetic properties. The sample was then placed in a convection furnace and heated at a rate of about 35° C. per hour to about 1400° C., and held at about that temperature for 4 hours. The sample lost its magnetic properties, and returned to an oxygen content of about 30.1 wt. %, indicating a re-transformation to hematite. No intrinsic gaps were observed when the sample was viewed under a microscope.

EXAMPLE 5

A monolithic hematite structure with an open-cell cor—cor design was fabricated from preforms made of layers of corrugated steel foil. Three steel preform bricks similar in size (5.7"×2.8"×1") to those described in Example 4 were made from 0.038 mm corrugated steel foil with almost equilateral cells (base 1.79 mm, height 1.30 mm, θ approx. 70°) with a cell density of about 560 cpsi. Outermost flat top and bottom layers, made from flat 0.1 mm steel foils, were positioned above and below the corrugated layers. The stacking corresponded to an angle 2α of 30, 45, and 90°, respectively, for the three bricks. The steel preforms were transformed into hematite structures by the procedure described in Example 1. The resulting hematite bricks were then cut by a diamond saw into eight standard 1"×1"×1" cubic samples which were tested for crush strength, as reported in Table VIII. For a given angle θ, the average strength was shown to monotonically increase with α.

TABLE VIII

| | C-AXIS CRUSH STRENGTH (MPa) Hematite Samples | | | | | | | | |
|---|---|---|---|---|---|---|---|---|---|
| 2α | 1 | 2 | 3 | 4 | 5 | 6 | 7 | 8 | Av. |
| 30° | 0.58 | 0.50 | 0.50 | 0.67 | 0.58 | 0.54 | 0.54 | 0.50 | 0.55 |
| 45° | 0.67 | 0.71 | 0.83 | 0.83 | 0.67 | 0.58 | 0.75 | 0.67 | 0.71 |
| 90° | 0.75 | 0.67 | 0.75 | 0.83 | 0.96 | 0.96 | 1.04 | 0.83 | 0.85 |

EXAMPLE 6

For each of nickel, copper, and titanium, two monolithic metal oxide structures in the shape of a cylindrical flow divider were fabricated by heating metal preforms in air. Cor-flat preforms, about 15 mm diameter and about 25 mm height, were made from metal foils having a thickness of 0.05 mm. The corrugated sheet had a triangular cell, with a base of 1.8 mm and a height of 1.2 mm. The corrugated sheet was placed on a flat sheet so that metal surfaces of the sheets were in close proximity, and the sheets were then rolled into a cylindrical body suitable as a flow divider. The body was then subjected to a heat treatment in a convection furnace similar to that described in Example 1, with some individual changes in the preferred working temperature and/or heating time, as described below.

Data on the weight and oxygen content for each sample are shown in Table IX. X-ray (Cu Kα radiation) powder diffraction spectra were obtained by using a diffractometer HZG-4 (Karl Zeiss), similar to the procedure for the iron oxides described in Examples 1 and 2 (Tables IV and V). Measured characteristic interplanar distances for the metal oxide powders are given in Tables X to XII, as compared to standard interplanar distances.

For nickel, both samples were heated first at 950° C. for 96 hours and then at 1130° C. for another 24 hours. The calculated oxygen content of the samples, determined by weight gain, were 21.37 and 21.38 wt. %, respectively, which are comparable to the theoretical content of 21.4 wt. % for the oxide NiO. X-ray powder data of the first sample, shown in Table X, indicate the formation of (black-greenish) bunsenite NiO. The nickel oxide structures retained substantially the metal preform shape. Although portions of the structure contained an internal gap indicative of the diffusional oxidation mechanism, the gap width was much smaller than that found in the hematite structures of Example 1.

For copper, the metal preforms were heated at 950° C., the first sample for 48 hours and the second one for 72 hours. Both metal oxide structures had a calculated oxygen content of 19.8 wt. %, based on weight gain, as compared to a theoretical content of 20.1 wt. % for the stoichiometric CuO. A red impurity, believed to be $Cu_2O$, was seen in the black matrix, which was believed to be CuO. X-ray powder data for the first sample, shown in Table XI, indicates predominant formation of tenorite, CuO. Similar to the nickel oxide structures, the copper oxide structures retained substantially the metal preform shape, and had a very thin internal gap.

For titanium, the two samples were heated at 950° C. for 48 and 72 hours, respectively, resulting in a calculated oxygen content of 39.6 and 39.9 wt. %, as compared to a theoretical content of 40.1 wt. % for the stoichiometric dioxide $TiO_2$. X-ray powder data for the first sample, shown in Table XII, indicates predominant formation of a white-yellowish rutile $TiO_2$ structure. The titanium oxide structures retained substantially the metal preform shape, with practically no internal gap. Examination of the structure under an optical microscope revealed a sandwich-like structure having three layers, a less dense (and lighter) internal layer, surrounded by two outer more dense (and darker) layers.

TABLE IX

WEIGHT MEASUREMENTS FOR METAL OXIDE SAMPLES

| Metal | Sample | Weight, g | | Oxygen content, wt. % | |
|---|---|---|---|---|---|
| | | metal | oxide | exp. | theor. |
| Ni | 1 | 2.502 | 3.182 | 21.37 | 21.4 |
| | 2 | 2.408 | 3.063 | 21.38 | 21.4 |
| Cu | 1 | 3.384 | 4.220 | 19.81 | 20.1 |
| | 2 | 3.352 | 4.179 | 19.79 | 20.1 |
| Ti | 1 | 1.253 | 2.073 | 39.56 | 40.1 |
| | 2 | 1.129 | 2.155 | 39.86 | 40.1 |

TABLE X

NiO (BUNSENITE)

| Interplanar distance, A | |
|---|---|
| experimental | standard |
| 2.429 | 2.40 |
| 2.094 | 2.08 |
| 1.479 | 1.474 |
| 1.260 | 1.258 |
| 1.201 | 1.203 |
| 1.040 | 1.042 |
| 0.958 | 0.957 |
| 0.933 | 0.933 |

TABLE XI

CuO (TENORITE)

| Interplanar distance, A | |
|---|---|
| experimental | standard |
| 2.521 | 2.51 |
| 2.309 | 2.31 |
| 1.851 | 1.85 |
| 1.496 | 1.50 |
| 1.371 | 1.370 |
| 1.257 | 1.258 |
| 1.158 | 1.159 |
| 1.086 | 1.086 |
| 0.980 | 0.978 |

TABLE XII $TiO_2$ (RUTILE)

| Interplanar distance, A | |
|---|---|
| experimental | standard |
| 3.278 | 3.24 |
| 2.494 | 2.49 |
| 2.298 | 2.29 |
| 2.191 | 2.19 |
| 1.692 | 1.69 |
| 1.626 | 1.62 |
| 1.497 | 1.485 |
| 1.454 | 1.449 |
| 1.357 | 1.355 |

TABLE XII-continued $TiO_2$ (RUTILE)

| Interplanar distance, A | |
|---|---|
| experimental | standard |
| 1.169 | 1.170 |
| 1.090 | 1.091 |
| 1.040 | 1.040 |

*For the first sample of each metal oxide in Table IX.

EXAMPLE 7

A hematite filter of high void volume was fabricated from Russian plain steel 3. The sample was fabricated by first making a brick-like preform having dimensions (length×width×height) of about 11×11×1.5 cm, made from about 76.4 grams of Russian steel shavings having a thickness varying from 50 to about 80 microns. The shavings density was made relatively uniform throughout the preform. The preform was then processed by heating at 800° C. for four days with the preform maintained inside a flat alumina jacket with asbestos insulation, under conditions similar to those described in Example 1. The desirable height about 1.0 cm was fixed by alumina blocks, and additional alumina plates weighing about 8 to 10 lbs. to provide an average pressure of 30 g/cm$^2$ were placed on top of the jacketed structure to provide additional pressure to ensure close contacts between adjacent layers of the steel preform.

The resulting unitary hematite structure had a size of 11.5×11.5×1.04 cm and a weight of 109.2 grams, and an oxygen content of about 30 wt. %, as determined by weight gain. The steel shavings had been transformed into hematite filaments having a thickness within the range of about 100 to 200 $\mu$m. Some of the hematite filaments contained internal, cylindrical holes.

The hematite filter structure was relatively brittle. The structure was cut to a size of 10.5×10.5×1.04 cm and then heated in an electrically heated high temperature furnace in air. The structure was placed in the furnace at ambient temperature, and maintained in the furnace without a ceramic jacket or insulation. The heating rate of the furnace was 2° C./min, and the furnace was heated from ambient temperature to about 1450° C. in about 12 hrs. Then, the hematite filter was held at about 1450° C. for three hours. Then the heat was turned off, and the sample was permitted to cool naturally in outside air to ambient temperature, which took about 15 hrs.

The resulting hematite structure was cut to a size of 10.2×10.2×1.04 cm and a total volume of 108.2 cm$^3$ and a weight of 85.9 gm. Based on an assumed hematite density of 5.24 g/cm$^3$, the calculated hematite volume was 16.4 cm$^3$. The hematite volume was calculated as constituting a filter solid fraction of 15.2 vol. % and a filter void volume of 84.8%. The filter structure became more uniform and crystalline than the initial hematite filter, and most of the internal holes in the filaments were closed. The structure was far less brittle, and could be cut by a diamond saw into various shapes.

EXAMPLE 8

A hematite filter having a high void volume was fabricated from US steel AISI-SAE 1010. The sample was fabricated by first making a brick-like preform having dimensions (length×width×height) of about 11×11×1.5 cm, a weight of 32.0 gm, made of AISI-SAE 1010 Texsteel, Grade 4, having filaments having an average thickness of about 0.1 mm. The textile density was made relatively uniform throughout the preform. The structure was then covered with a 11×11 cm steel screen made of Russian plain steel 3 having a thickness of about 0.23 mm, an internal cell size of 2.1×2.1 mm, and a weight of 19.3 gm. The resulting preform was then processed by heating at 800° C. for four days, with the preform maintained inside a flat alumina jacket with asbestos insulation, under conditions similar to those described in Example 1. The desirable height of 7.0 mm was fixed by alumina blocks, and additional alumina plates weighing about 8 to 10 lbs. were placed on top of the jacketed structure to provide additional pressure of up to about 30 gm/cm$^2$ to ensure close contacts between adjacent layers of the steel preform.

In the resulting unitary hematite structure, a hematite screen was permanently attached to a hematite filter core. The screen covered (and protected) the core. The hematite structure had a weight of 73.4 gm and an oxygen content of 30.1 wt %, as determined by weight gain. The core had an average filament thickness of about 0.2 to 0.25 mm. The screen had an internal cell size of about 1.5×1.5 mm. Both the screen and filaments typically had internal gaps or holes.

The structure was then heated in an electrically heated high temperature furnace in air. The structure was placed in the furnace at ambient temperature, and maintained in the furnace without a ceramic jacket or insulation. The heating rate of the furnace was 2° C./min, and the furnace was heated from ambient temperature to about 1450° C. in about 12 hrs. Then, the hematite filter was held at about 1450° C. for three hours. Then the heat was turned off, and the sample was permitted to cool naturally in outside air to ambient temperature, which took about 15 hrs.

The resulting hematite structure was cut to a size of 10.2×10.2×0.7 cm and a weight of 63.1 gm. The filter core weighed 39.4 gm, and the screen weighed 23.7 gm. Based on an assumed hematite density of 5.24 g/cm$^3$, the calculated hematite core volume was 7.5 cm$^3$, the calculated hematite screen volume was 4.5 cm$^3$. The total volume of the structure was calculated as 72.8 cm$^3$, and 68.3 cm$^3$ without the screen. The hematite core volume was calculated as constituting a filter solid fraction of 11 vol. % (7.5/68.3) and a filter void volume of 89%.

What is claimed is:

1. A method for making a monolithic metal oxide structure, said method comprising the steps of:

providing a structure containing a metal selected from the group consisting of iron, nickel, titanium, and copper, wherein the metal-containing structure contains a plurality of surfaces in close proximity to one another, and heating the metal-containing structure in an oxidative atmosphere below the melting point of the metal while maintaining the close proximity of the metal surfaces to uniformly oxidize the structure and directly transform the metal to metal oxide to form a uniform metal oxide structure selected from the group consisting of an iron oxide structure, a nickel oxide structure, a titanium oxide structure and a copper oxide structure, such that the oxidation of the metal in the metal-containing structure is substantially complete and the metal oxide structure is monolithic and retains substantially the same physical shape as the metal-containing structure.

2. A method according to claim 1, wherein the oxidative atmosphere is air.

3. A method according to claim 1, wherein the metal is iron, and the metal-containing structure is heated below about 1500° C. to oxidize the iron substantially to hematite.

4. A method according to claim 3, wherein the iron-containing structure is heated between about 750° C. and about 1200° C.

5. A method according to claim 4, wherein the iron-containing structure is heated between about 800° C. and about 950° C.

6. A method according to claim 1, wherein the metal is nickel, and the metal-containing structure is heated below about 1400° C. to oxidize the nickel substantially to bunsenite.

7. A method according to claim 6, wherein the nickel-containing structure is heated between about 900° C. and about 1200° C.

8. A method according to claim 7, wherein the structure is heated between about 950° C. and about 1150° C.

9. A method according to claim 1, wherein the metal is copper, and the structure is heated below about 1000° C. to oxidize the copper substantially to tenorite.

10. A method according to claim 9, wherein the structure is heated between about 800° C. and about 1000° C.

11. A method according to claim 10, wherein the structure is heated between about 900° C. and 950° C.

12. A method according to claim 1, wherein the metal is titanium, and the structure is heated below about 1600° C. to oxidize the titanium substantially to rutile.

13. A method according to claim 12, wherein the titanium-containing structure is heated between about 900° C. and about 1200° C.

14. A method according to claim 13, wherein the structure is heated between about 900° C. and about 950° C.

* * * * *

UNITED STATES PATENT AND TRADEMARK OFFICE

CERTIFICATE OF CORRECTION

PATENT NO. : 6,045,628
DATED : April 4, 2000
INVENTOR(S) : SOLNTSEV et al.

It is certified that error appears in the above-identified patent and that said Letters Patent is hereby corrected as shown below:

Column 3, line 7, change "does not" to - -do not- -;

Column 6, line 51, change "0.03" to - -0.3- -;

Column 8, line 46, change "an" to - -can- -;

Column 10, line 26, change "at" to - -are- -;

Column 10, line 46, change "80" to - -800- -;

Column 20, line 42, change "be" to - -have- -; and

Column 21, line 57, change "hr" to - -yr- -.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*